US008021174B1

(12) United States Patent
Schutte

(10) Patent No.: US 8,021,174 B1
(45) Date of Patent: Sep. 20, 2011

(54) CORD SECURING COVER FOR AN ELECTRICAL OUTLET

(75) Inventor: Michael J. Schutte, Cornelius, NC (US)

(73) Assignee: StayConnect, LLC, Cornelius, NC (US)

( * ) Notice: Subject to any disclaimer, the term of this patent is extended or adjusted under 35 U.S.C. 154(b) by 0 days.

(21) Appl. No.: 12/898,704

(22) Filed: Oct. 5, 2010

Related U.S. Application Data

(60) Provisional application No. 61/248,877, filed on Oct. 5, 2009.

(51) Int. Cl.
*H01R 13/62* (2006.01)

(52) U.S. Cl. ..... 439/144; 439/373

(58) Field of Classification Search ..... 439/144, 439/373; 174/67
See application file for complete search history.

(56) References Cited

U.S. PATENT DOCUMENTS

| | | | | |
|---|---|---|---|---|
| 3,428,936 | A | 2/1969 | Arnao, Jr. | |
| 4,070,078 | A | 1/1978 | Chrones | |
| 4,083,618 | A * | 4/1978 | Busch, Jr. | 439/147 |
| 4,134,516 | A | 1/1979 | Sullo | |
| 4,424,407 | A | 1/1984 | Barbie | |
| 4,456,145 | A | 6/1984 | Frank | |
| 4,508,933 | A | 4/1985 | Carvel | |
| 4,660,912 | A | 4/1987 | Tomek | |
| 4,760,215 | A | 7/1988 | Cook et al. | |
| 4,803,307 | A | 2/1989 | Shotey | |
| 5,045,640 | A * | 9/1991 | Riceman | 174/67 |
| 5,218,169 | A | 6/1993 | Riceman | |
| 5,243,135 | A | 9/1993 | Shotey | |
| D342,233 | S | 12/1993 | Berlin et al. | |
| 5,317,108 | A | 5/1994 | Prairie, Jr. | |
| 5,408,046 | A | 4/1995 | Vandeventer | |
| 5,430,253 | A | 7/1995 | Pratt | |
| 5,547,390 | A * | 8/1996 | Laherty | 439/373 |
| 5,556,289 | A | 9/1996 | Holbrook, Jr. | |
| 5,731,544 | A | 3/1998 | Burch et al. | |
| D400,507 | S | 11/1998 | Monaco | |
| 5,912,432 | A | 6/1999 | Thomas | |
| 5,934,919 | A | 8/1999 | Cross et al. | |
| 5,989,052 | A | 11/1999 | Fields et al. | |
| 6,108,178 | A | 8/2000 | Beadles | |
| 6,309,239 | B1 * | 10/2001 | Johnston | 439/373 |
| D460,421 | S | 7/2002 | Marozsan, Jr. | |
| 6,805,580 | B2 | 10/2004 | Piedmont | |
| 7,056,145 | B2 | 6/2006 | Campbell, III et al. | |
| 7,097,474 | B1 | 8/2006 | Naylor | |
| 7,148,421 | B2 | 12/2006 | Nagashima et al. | |
| 7,284,995 | B1 | 10/2007 | Vail | |
| 7,431,594 | B2 * | 10/2008 | Castaldo et al. | 439/135 |

* cited by examiner

*Primary Examiner* — Gary F. Paumen
(74) *Attorney, Agent, or Firm* — Everman Law Firm, P.A.; Gregory R. Everman

(57) ABSTRACT

An outlet cover for an electrical outlet which prevents unintentional disconnection of an electrical plug of an electrical cord from the electrical outlet. The outlet cover includes a plate having at least one opening sized and positioned to receive the electrical plug and a lid hingedly attached to the plate so that the lid can be moved between an open position that allows access to the electrical outlet and a closed position wherein the electrical outlet is covered by the lid. The lid includes a base having an outward facing surface, a prong having a proximal portion connected to, and extending outwardly from, the base, and a distal portion that is spaced from the base by the proximal portion, and at least one bump extending outwardly from the outward facing surface of the base. The electrical cord is positioned between the prong and the base, and also between the prong and the at least one bump such that the electrical cord engages the prong and the at least one bump. Accordingly, the prong and the at least one bump cooperate together to secure the electrical cord such that the electrical plug is not unintentionally disconnected from an electrical outlet when tension forces are applied to the electrical cord.

20 Claims, 47 Drawing Sheets

CORD SECURING COVER FOR AN ELECTRICAL OUTLET

CROSS REFERENCE TO RELATED APPLICATIONS

This application claims the benefit of U.S. Provisional Application No. 61/248,877, filed Oct. 5, 2009, which is incorporated herein in its entirety.

BACKGROUND OF THE INVENTION

1. Field of the Invention

The present invention relates to the field of safety covers for electrical outlets and, more specifically, to an outlet cover for electrical outlets which prevents unintentional disconnection of an electrical plug from an electrical outlet.

2. Description of the Related Art

It is aggravating to the user of an electrical appliance, such as a vacuum cleaner, to have the power thereto be interrupted during use because the plug has either become loosened or dislodged from the outlet due to various tensions being placed on the power cord.

Other related problems are that electrical plugs occasionally do not fit tightly into electrical outlet receptacles or the prongs become bent, causing frequent disengagement of power to electrically powered devices when the plug loosens from the outlet. Further problematic with loose fitting plugs, particularly where the cord is lengthy or an extension cord is being used, is that the cord can become electrically disconnected from the receptacle simply by the weight of the cord.

Numerous power cord retaining devices have been configured in an attempt to solve the aforementioned problems, but all are not without problems of their own. For example, some power cord retaining devices are large and bulky, creating an obstacle that persons, particularly children, could inadvertently engage when passing or playing near such devices. And, of course, bulky retaining devices are generally unaesthetic, without designer form or style, and thus often not desirable for in-home use.

Another problem is that electrical outlets are oftentimes locate behind furniture or appliances and, in such cases, bulky power cord securing devices may also interfere with placement of furniture and appliances.

Additionally, many known cord securing devices have complex attachment mechanisms which are not well suited for quick and easy attachment and removal of a power cord, particularly when accessibility to the device is limited, for example when located behind furniture, or when an adult has limited dexterity. For convenience, it is also desirable that the cord securing device remain mounted at the outlet whether or not the device is being used.

A further problem is that some cord securing devices have a complex configuration which increases the cost of the devices and/or have removable parts which could inadvertently become lost rendering such devices useless.

Furthermore, many known cord securing devices are not weatherproof and, therefore, their use is restricted to the interior of a building, leaving unresolved the ability to secure power cords to outdoor electrical outlets.

Accordingly, there is a need in the art of continued improvement of power cord retaining devices in the form of an outlet cover which maintains position of a power cord to an electrical plug despite tensions being placed on the power cord such that power is not interrupted to the power cord. Also needed in the art is for a power cord retaining device having a non-bulky, low profile structure such that it does not interfere with furniture placement and can be configured in aesthetically appealing designs suitable for interior use. Moreover, there is needed in the art for a power cord retaining device to which a power cord can be quickly and simply secured and removed as desired. Further there is a need in the art for a power cord retaining device which is suitable for both indoor and outdoor use. Still further, there is a need in the art for a power cord retaining device that remains attached at an electrical outlet, whether or not in use, and has no separate parts that could otherwise become lost.

BRIEF SUMMARY OF THE INVENTION

To achieve the foregoing and other objects, the present invention, as embodied and broadly described herein, provides various embodiments of a outlet cover which secures a power cord from inadvertently becoming disengaged from an electrical outlet.

The present invention is an outlet cover for an electrical outlet which prevents unintentional disconnection of an electrical plug of an electrical cord from the electrical outlet. The outlet cover includes a plate having at least one opening sized and positioned to receive the electrical plug and a lid hingedly attached to the plate so that the lid can be moved between an open position that allows access to the electrical outlet and a closed position wherein the electrical outlet is covered by the lid. The lid includes a base having an outward facing surface, a prong having a proximal portion connected to, and extending outwardly from, the base, and a distal portion that is spaced from the base by the proximal portion, and at least one bump extending outwardly from the outward facing surface of the base. The electrical cord is positioned between the prong and the base, and also between the prong and the at least one bump such that the electrical cord engages the prong and the at least one bump. Accordingly, the prong and the at least one bump cooperate together to secure the electrical cord such that the electrical plug is not unintentionally disconnected from an electrical outlet when tension forces are applied to the electrical cord. In more preferred embodiments, the at least one bump includes first and second bumps, which are on opposed sides of the prong. Additionally, the prong and bumps are elongate, about the same in length, and have longitudinal axes that are generally parallel with each other. By having the electrical cord being engaged between the prong and bumps, tension forces applied to the cord are resisted by the prong and bumps so that the forces do not cause the cord to become unintentionally disconnected from the outlet.

The present invention also includes a method of securing an electrical cord to prevent unintentional disconnection of the electrical cord from an electrical outlet. The method includes the steps of providing an outlet cover. The outlet cover includes a plate having at least one opening sized and positioned to receive the electrical plug, a lid hingedly attached to the plate wherein the lid includes a base having an outward facing surface, a base having an outward facing surface, a prong having a proximal portion connected to, and extending outwardly from, the base, and a distal portion that is spaced from the base by the proximal portion, and at least one bump extending outwardly from the outward facing surface of the base. The method further includes the steps of moving the lid to an open position that allow for access to the electrical outlet; inserting the electrical cord through the at least one opening; plugging the electrical cord to the electrical outlet; positioning the electrical cord between the prong and the base; positioning the electrical cord between the prong and the at least one bump whereby the electrical cord is engaged against the prong and the at least one bump; applying a tension force to the electrical cord; and restricting movement of the electrical cord by engaging the electrical cord against the prong and at least one bump such that the electrical cord does not become disengaged from the electrical outlet. More preferably, the method further includes the steps of positioning the electrical cord over the first and second bumps and below the distal end of the prong, and restricting tension forces applied to the electrical cord from being transmitted to the electrical plug.

BRIEF DESCRIPTION OF THE DRAWINGS

The above described and other features, aspects, and advantages of the present invention are better understood when the following detailed description of the invention is read with reference to the accompanying drawings, wherein.

DESCRIPTION OF THE PREFERRED EMBODIMENTS

The present invention will now be described more fully hereinafter with reference to the accompanying drawings in which preferred embodiments of the invention are shown. This invention may, however, be embodied in many different forms and should not be considered as limited to the embodiments set forth herein. These exemplary embodiments are provided so that this disclosure will be both thorough and complete, and will fully convey the scope of the invention to those skilled in the art. Use of alpha-numeric reference numbers, in which the numeric portion is the same in different embodiments identifies that the element is functionally substantially similar in the various embodiments, whereas differences in the alpha portion identifies different embodiments. Accordingly, the description associated with a reference number, e.g. 20, is understood to be read into reference numbers with a different alpha portion, e.g. 20*b*, except as otherwise noted.

The present invention is an outlet cover for an electrical outlet, which is configured to keep a power cord of an appliance, device, extension cord or the like (collectively "appliance") in electrical connection with an electrical plug. Thus, the invented outlet cover keeps power to the appliance from being inadvertently interrupted due to having the power cord plug become loose or dislodged from the outlet as a result of tension forces being applied on the power cord.

Advantageously, once installed, the invented outlet cover remains attached to the electrical outlet and has no separate parts that could otherwise become lost. The invented outlet cover also has a low profile such that it can be positioned on outlets located behind the furniture and appliances. The outlet cover is simple in configuration and use, thereby allowing for a power cord to be secured to and removed from both the cover and outlet with ease. The invented outlet cover is aesthetically suitable for indoor use while being weatherproof for outdoor application.

Figure 1:
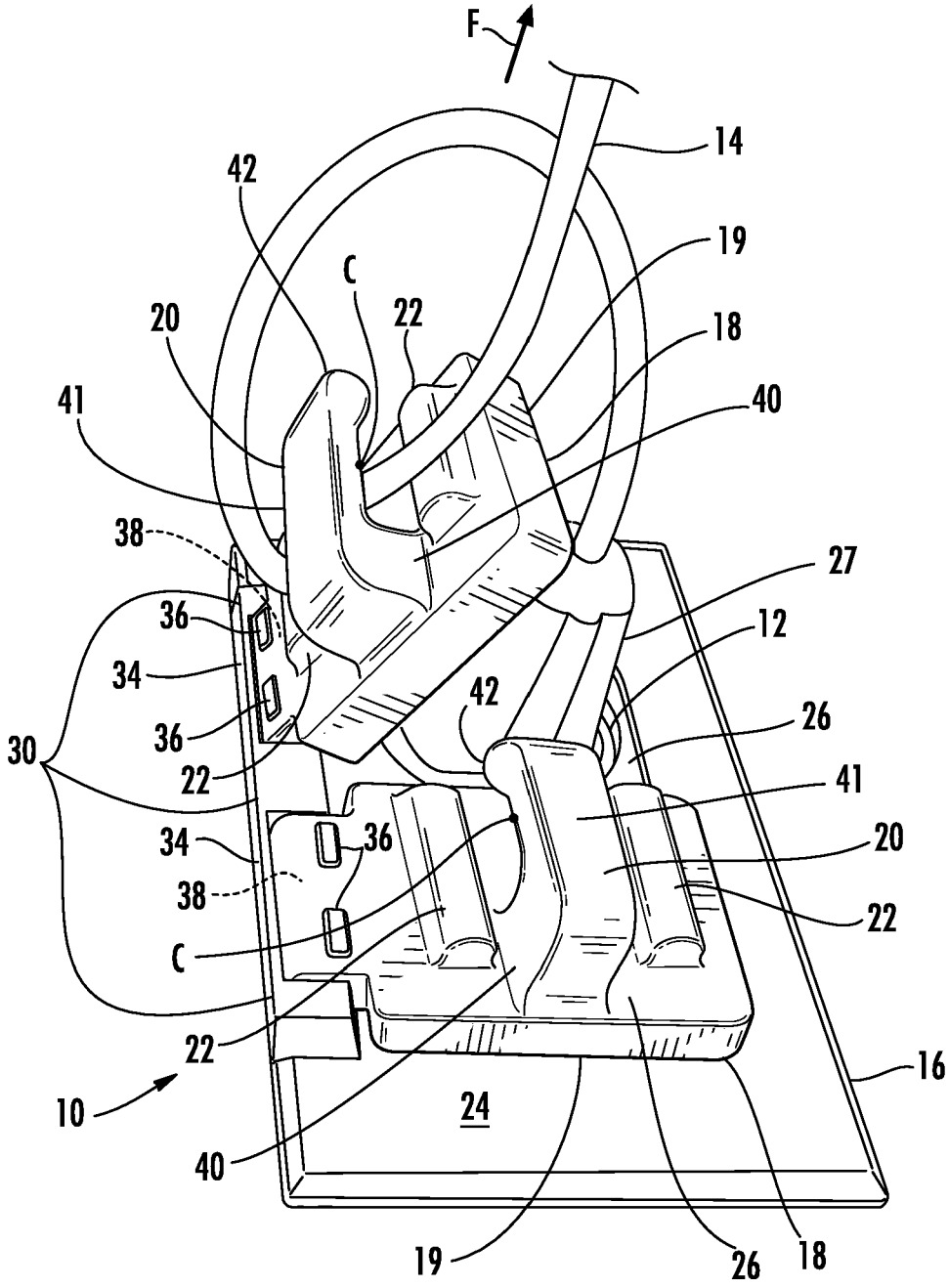
FIG. 1 is a perspective view of a power cord securing outlet cover having an upwardly directed prong and being suitable for application with a standard electrical outlet, shown in use securing a power cord from being inadvertently electrically disconnected from the outlet, in accordance with an embodiment of the present invention.

Referring to the drawings, and particularly FIG. 1, the illustrated invented outlet cover 10 is shown in use as applied to a standard electrical outlet 12 (a wall is not illustrated) and securing an electrical power cord 14. The outlet cover 10 includes a base plate 16, which provides a protective barrier over an electrical box (not shown) to keep undesired foreign objects from entering therein, and at least one hinged lid 18 (typically two hinged lids 18 for most outlets) that may selectively be moved between open and closed positions for allowing access to the electrical outlets 12. Each lid 18 includes a base 19 that carries a raised prong 20 and at least one protruding bump 22 (two protruding bumps 22 are shown in the preferred embodiment) which cooperate together to hold an electrical power cord 14 in a secure position while the associated appliance is in use.

Figure 3:
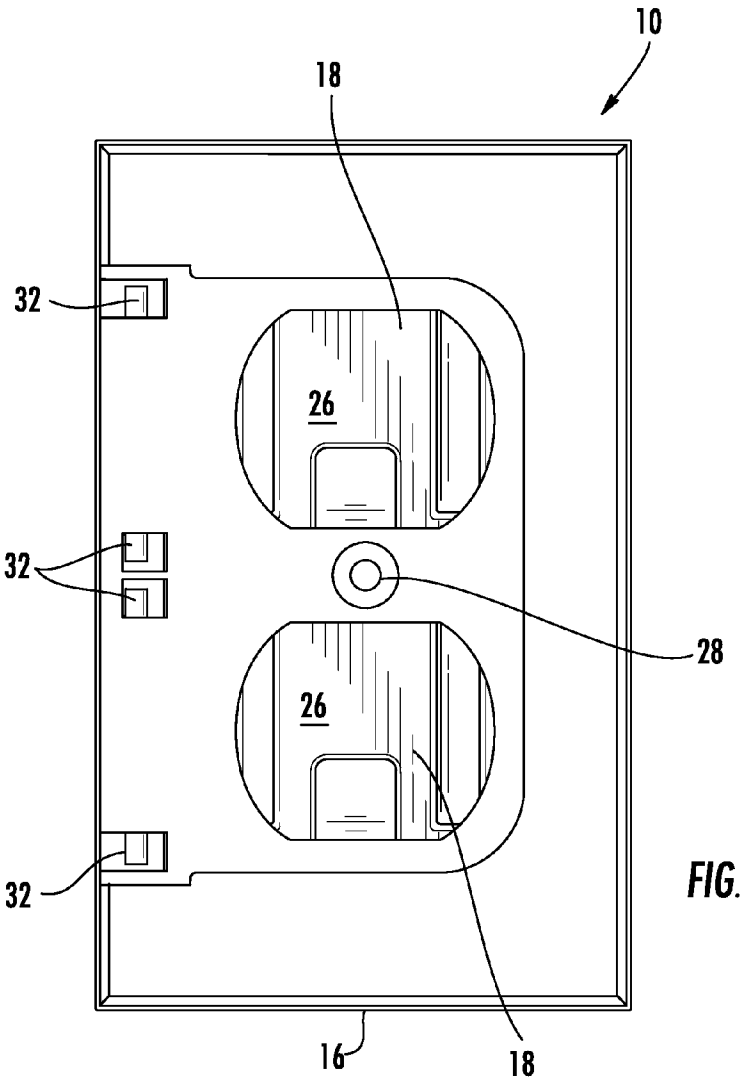
FIG. 3 is a rear elevational view of the outlet cover of FIG. 1.
Figure 2:
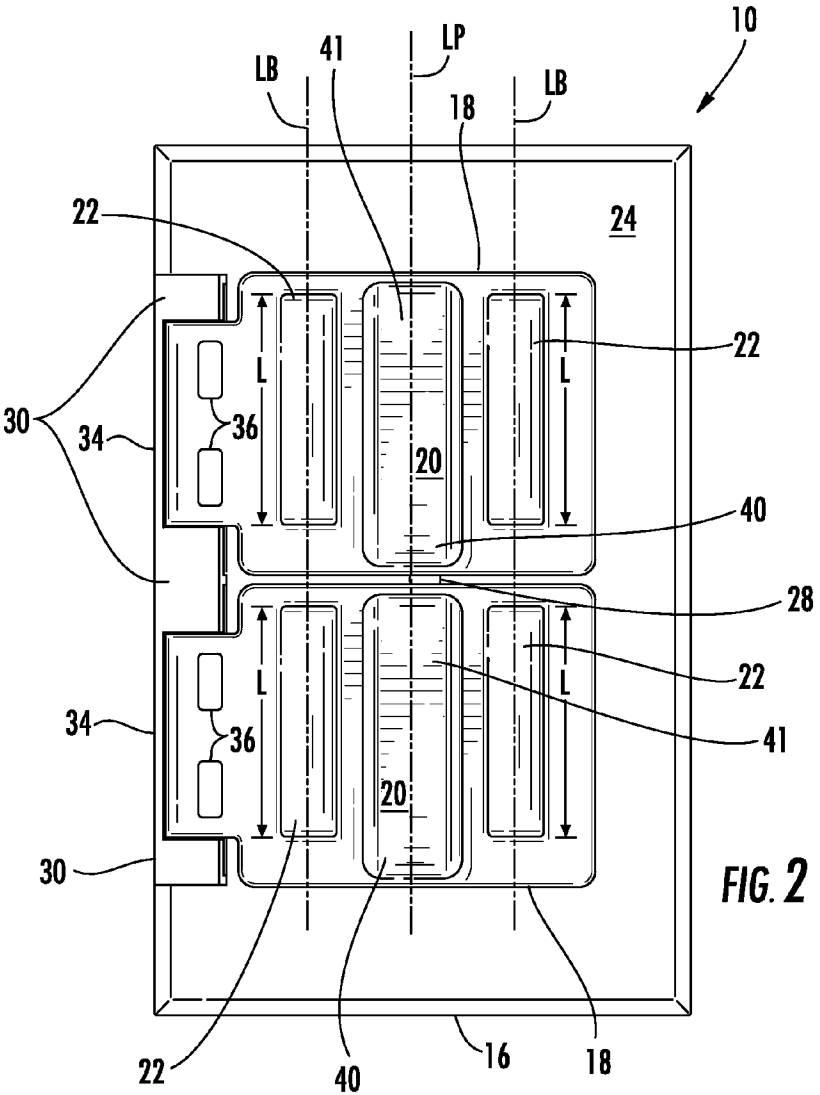
FIG. 2 is a front elevational view of the outlet cover of FIG. 1.
Figure 3A:
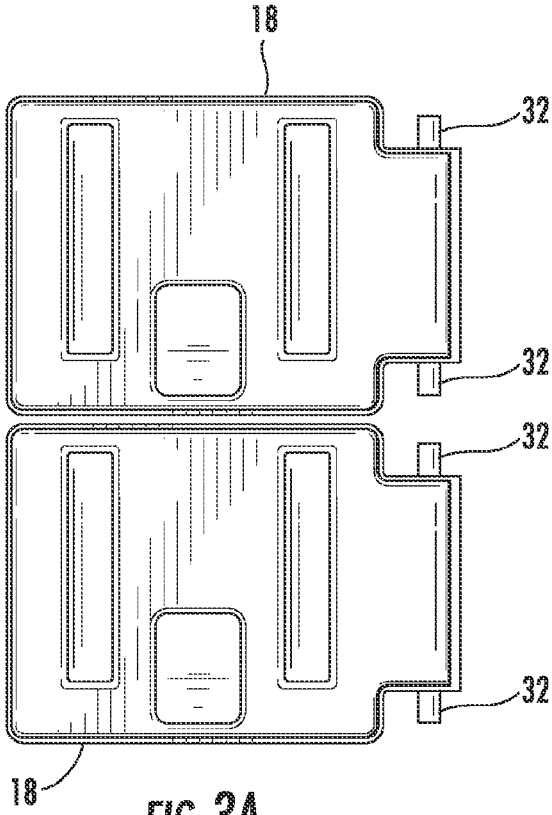
FIG. 3A is a rear detail view showing only the lids of the outlet cover of FIG. 1.
Figure 4:
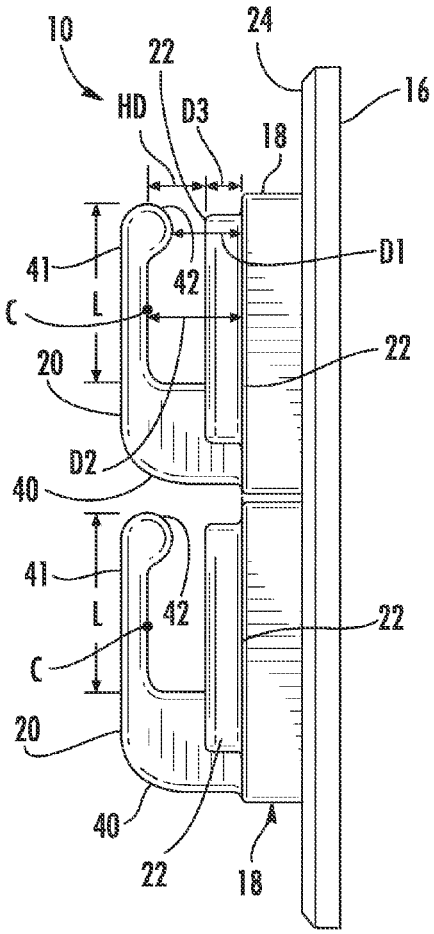
FIG. 4 is a right side elevational view of the outlet cover of FIG. 1.
Figure 5:
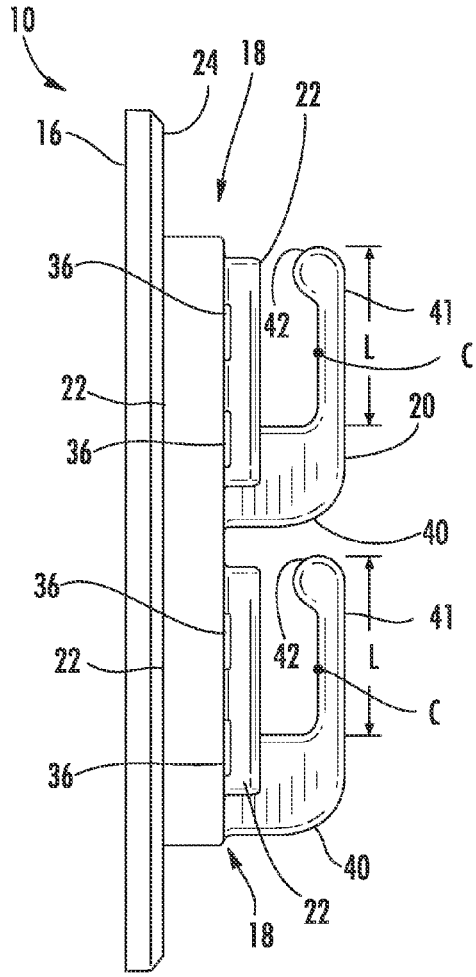
FIG. 5 is a left side elevational view of the outlet cover of FIG. 1.
Figure 6:
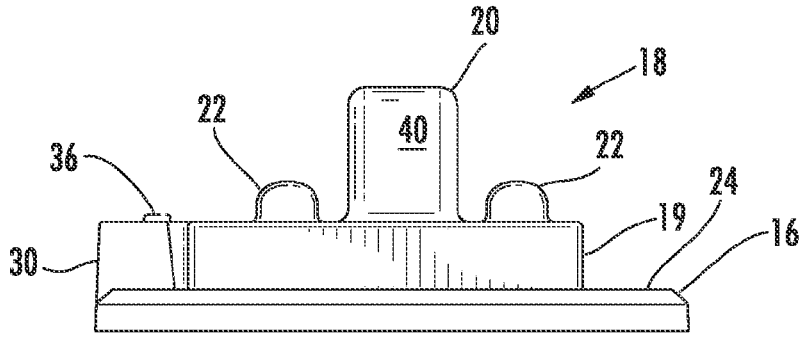
FIG. 6 is a bottom plan view of the outlet cover of FIG. 1.
Figure 6A:
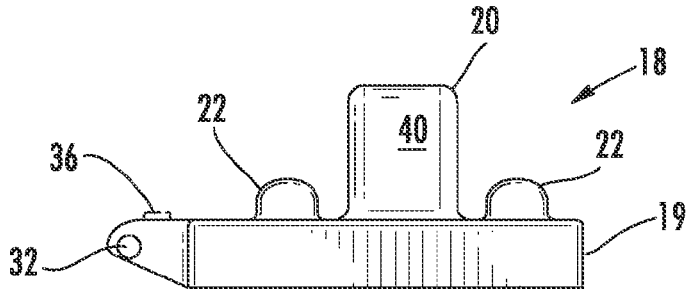
FIG. 6A is a bottom detail view showing only the lid of the outlet cover of FIG. 1.
Figure 7:
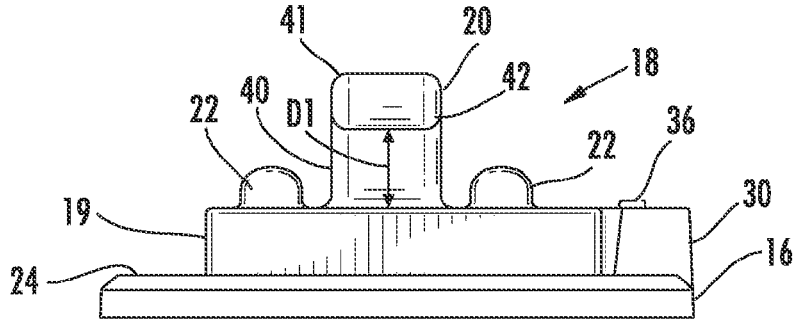
FIG. 7 is a top plan view of the outlet cover of FIG. 1.
Figure 7A:
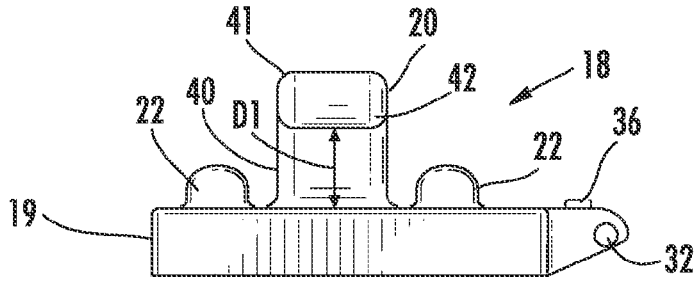
FIG. 7A is a top detail view showing only the lid of the outlet cover of FIG. 1.

Referring to FIGS. 1 and 3, the base plate 16 is sized to provide a protective barrier to keep unwanted objects from entering the electrical box and has a conventional configuration with a substantially planar outward face 24 so as to look similar to standard base plates. A pair of openings 26 is provided in the base plate 16, having suitable size and shape to allow access of electrical plugs 27 to the electrical outlets 12 (FIG. 1). A small aperture 28 is provided between the pair of openings 26 for securing the outlet cover 10 to the electrical outlet 12 via a mechanical fastener (not shown).

Articulation of the lids 18 is achieved by conventional means as known in hinged outlet covers common in exterior use. For example, the base plate 16 includes housings 30 which receive and retain axles 32 (FIGS. 3, 3A, 6A and 7A) of the lids 18 to allow relative rotation between the lids 18 and base plate 16, and abutments surfaces 34 which limit the degree to which the lids 18 can be rotated in the open direction before engaging detents 36 provided on the lids 18. Springs 38 (not illustrated in detail), such as leaf springs, are sandwiched between the base plate 16 and axles 32 thereby urging the lids 18 towards a closed position.

Referring to FIGS. 1-2 and 4-7A, in the preferred embodiment, the prong 20 has a proximal portion 40 that is connected to, and extends outwardly from, the base 19, and a distal portion 41 that is spaced from the base 19 by the proximal portion 41. The distal portion 41 is elongate, having a length (L) of at least ⅓ inch along its longitudinal axis (LP), an enlarged distal end 42, and a center point (C) along its length (L). The enlarged distal end 42 extends towards the base 19 such that the distance (D1) between the distal end 42 and base 19 is less than the distance (D2) between the center point (C) of the distal portion 41 and base 19. Although not to be construed as limiting, preferably the distance between the center point (C) and base 19 is about ½ inch and the distance (D1) between the distal end 42 and base 19 is about ⅜ inch so that a typical power cord 14 (e.g. a power cord from a vacuum cleaner) will snuggly fit between the center point (C) and base 19 whereas the distal end 42 forms a pinch point to keep the power cord 14 from unintentionally being pulled from the outlet cover 10.

The bumps 22 protrude outwardly from the base 19 and are positioned on opposed sides of the prong 20. Preferably, the bumps 22 are elongate, protrude by at least ⅛ inch from the base 19, and have a length (L) along their longitudinal axes (LB) of at least ⅓ inch. Also preferably, the prong 20 and bumps 22 are aligned such that their longitudinally axes (LP, LB) are parallel or generally parallel with each other. By being parallel and having about the same length, the cord 14 will not only be positioned between the prong 20 and base 19, but will also necessarily be positioned between the prong 20 and bumps 22. As the bumps 22 are raised and the prong 20 sets an outer boundary, the cord 14 is caused to travel a non-linear, slightly U-shaped path over the bumps 22 and under the prong 20 in which the cord 14 engages the bumps 22 and prong 20 to secure it in place. Ideally, the cord 14 has a diameter that a little greater than the height difference (HD) of the center point (C) compared to the height (D1) of the bumps 22. The height (D2) of the center point (C) is measured from the center point (C) (i.e. measured from the bottom surface of the distal portion 40 at its center point) to the nearest surface of the base 19. Thus, height difference (HD) is determined by: HD=D2-D1. Height difference (HD) determines whether the cord 14 will be required to take a non-linear path when secured by the outlet cover 10. That is, wherein the diameter of the cord 14 is greater than the height difference (HD), the cord 14 is caused to take a curved path between the prong 20 and bumps 22 such that the cord 14 engages and reacts against the prong 20 and bumps 22.

Due to the interference fit between the cord 14 and prong 20, and between the cord 14 and bumps 22, tension forces (F) applied to the portion of the cord 14 that is electrically downstream of the outlet cover 10 are offset by engagement of the cord 14 with the prong 20 and bumps 22 such that the forces (F) are not transmitted to the electrical plug 27. Thus, the electrical cord 14 remains in electrical contact with the outlet 12. As used herein, the phrase a "tension force is applied to the electrical cord" means that a continuous tension force of 10 N, more preferably 20 N and most preferably 30 N was continuous applied to the electrical cord at a location electrically downstream from the outlet cover 10 at a direction 90 degrees to the electrical outlet 27 (i.e. parallel to the direction that prongs of the plug 27 entered the electrical outlet), for a period of 15 seconds. When a tension force is applied to the electrical cord 14, the cord 14 reacts against the prong 20 and bumps 22 whereby forces of less than 0.5 N, and more preferably 0 N, are transmitted through the cord 14 to the plug 27. By having the tension forces F offset by the outlet cover 10, the plug 27 remains in electrical contact with the outlet 12.

Figure 8:
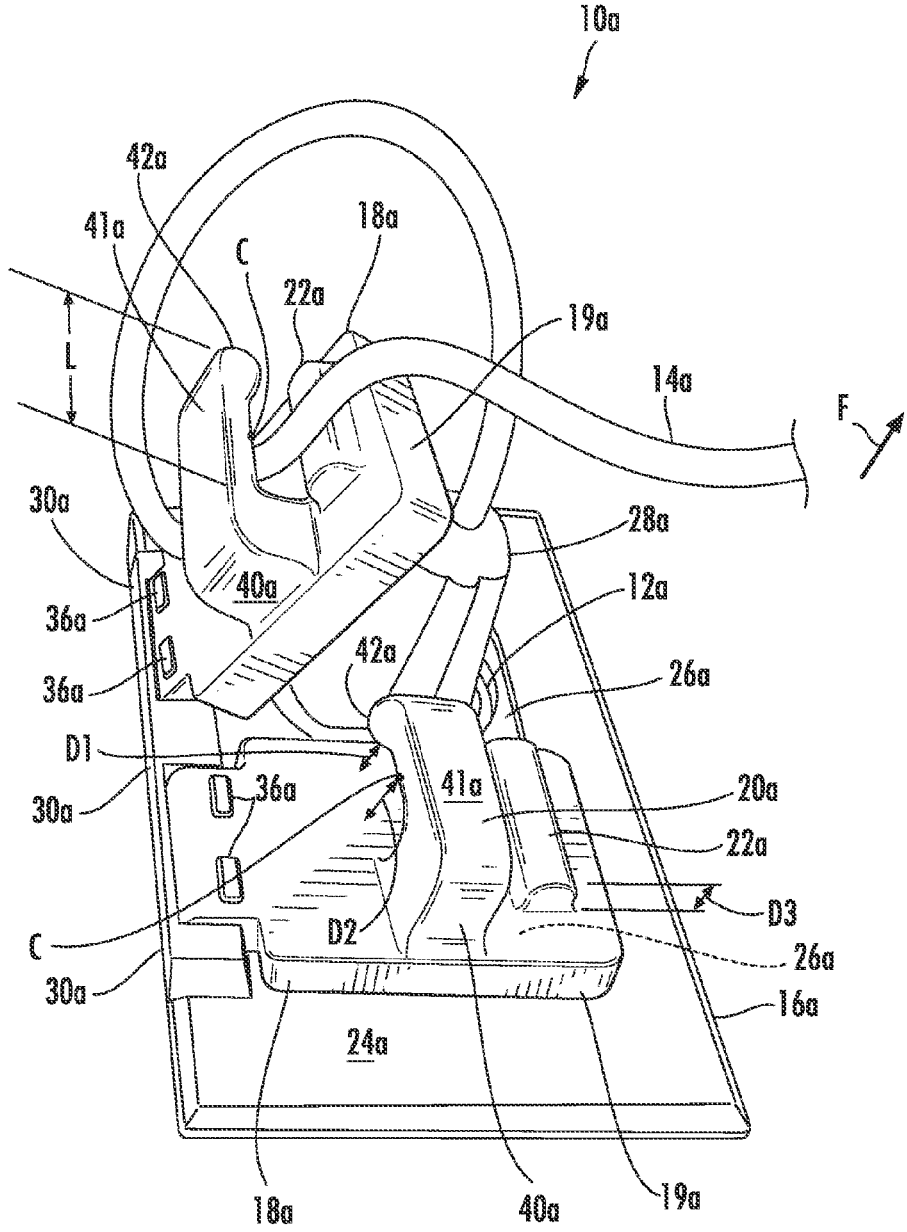
FIG. 8 is a perspective view of an alternative power cord securing outlet cover, having an upwardly directed prong, only one protruding bump, and being suitable for application with a standard electrical outlet, shown in use securing a power cord from being inadvertently electrically disconnected from the outlet, in accordance with an alternative embodiment of the present invention.
Figure 9:
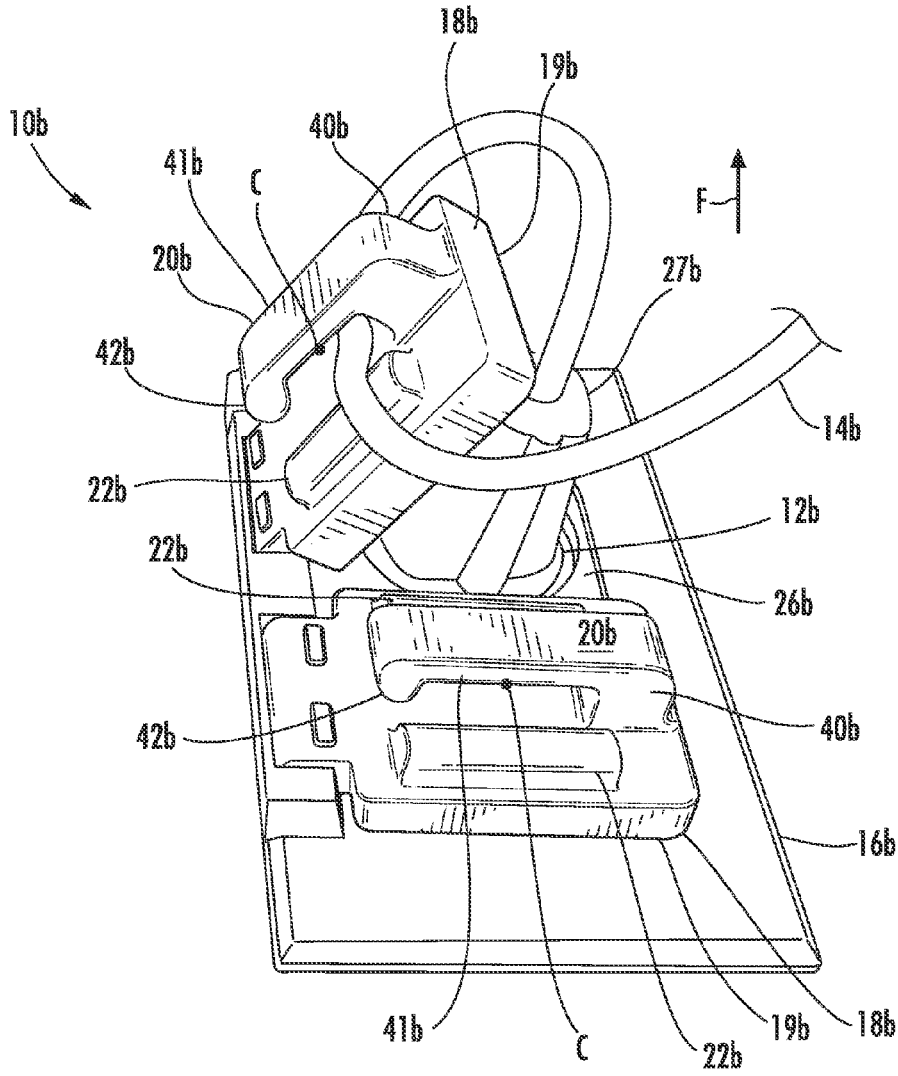
FIG. 9 is a perspective view of another alternative power cord securing outlet cover, having a leftwardly directed prong and suitable for application with a standard electrical outlet, shown in use securing a power cord from being inadvertently electrically disconnected from the outlet, in accordance with an alternative embodiment of the present invention.
Figure 11:
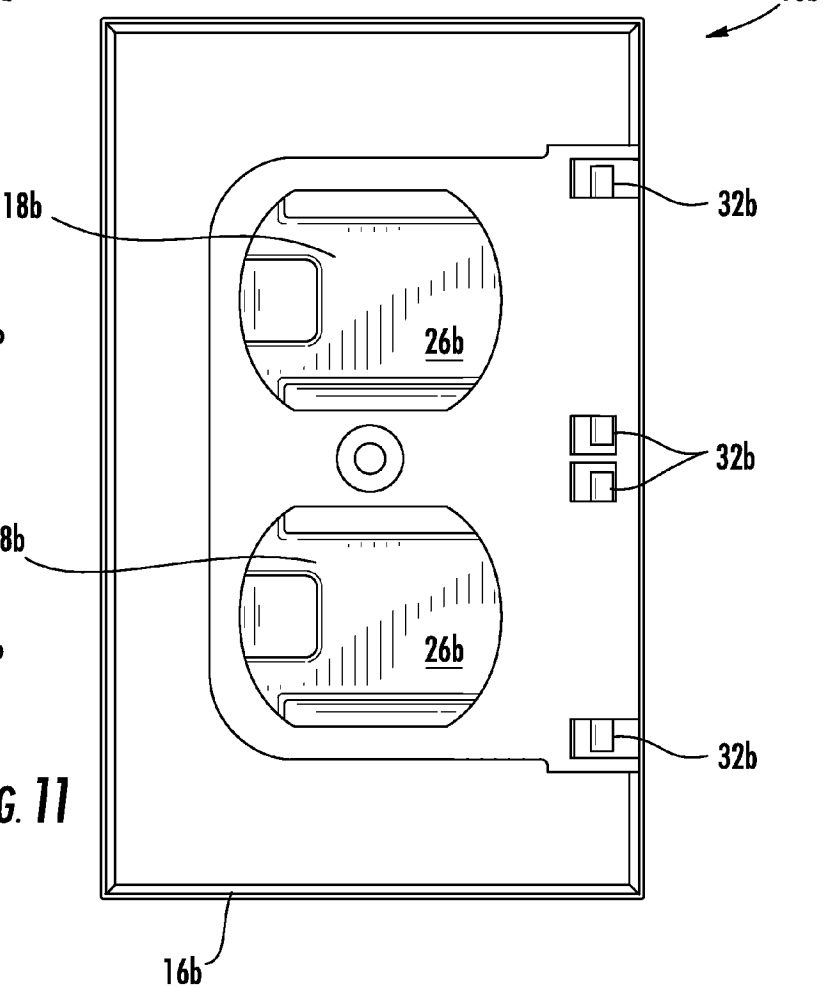
FIG. 11 is a rear elevational view of the outlet cover of FIG. 9.
Figure 10:
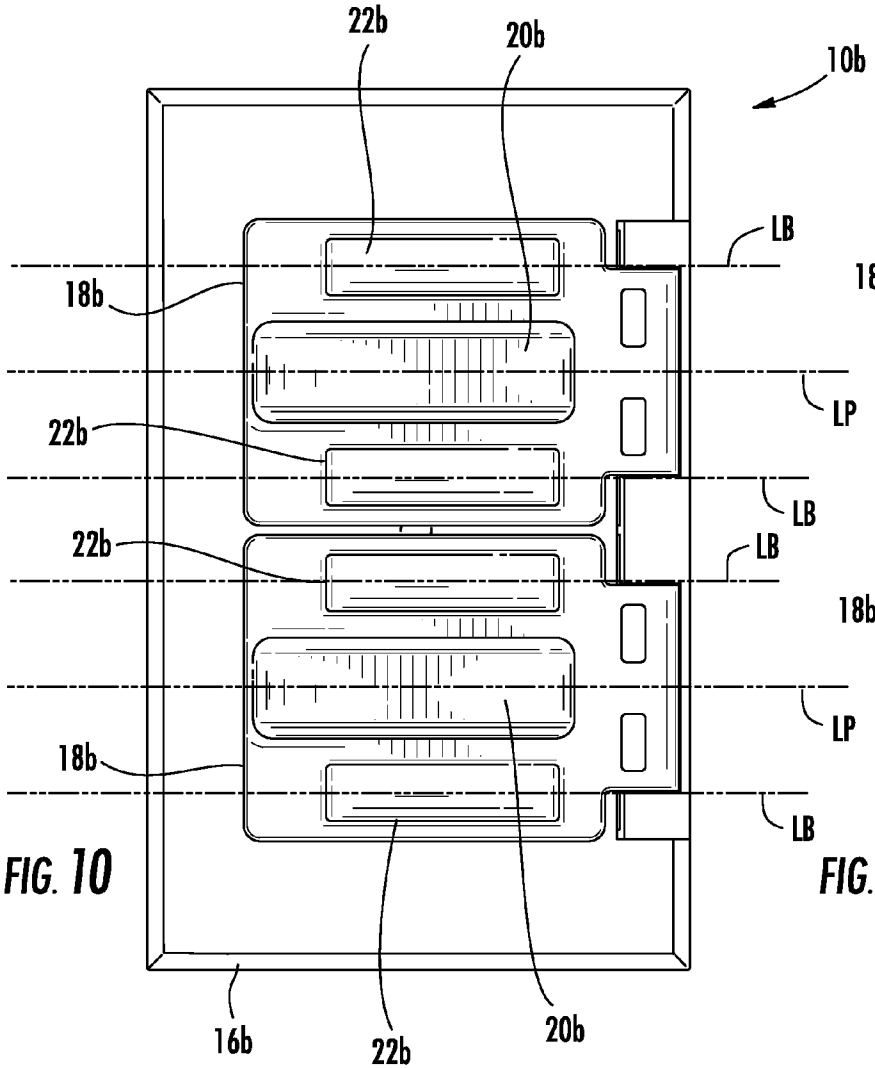
FIG. 10 is a front elevational view of the outlet cover of FIG. 9.
Figure 11A:
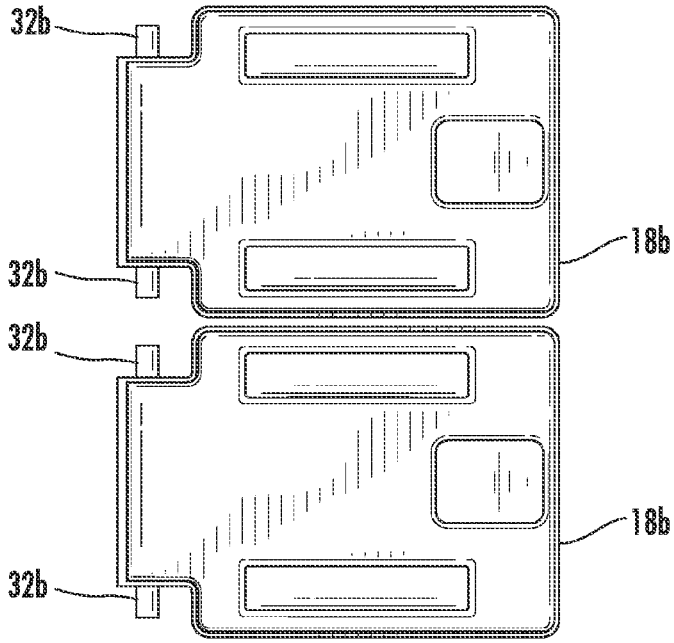
FIG. 11A is a rear detail view showing only the lids of the outlet cover of FIG. 9.
Figure 13A:
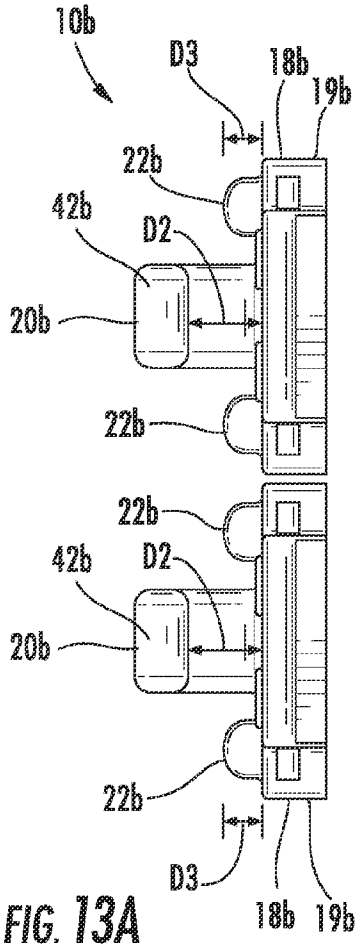
FIG. 13A is a left side detail view showing only the lids of the outlet cover of FIG. 9.
Figure 13:
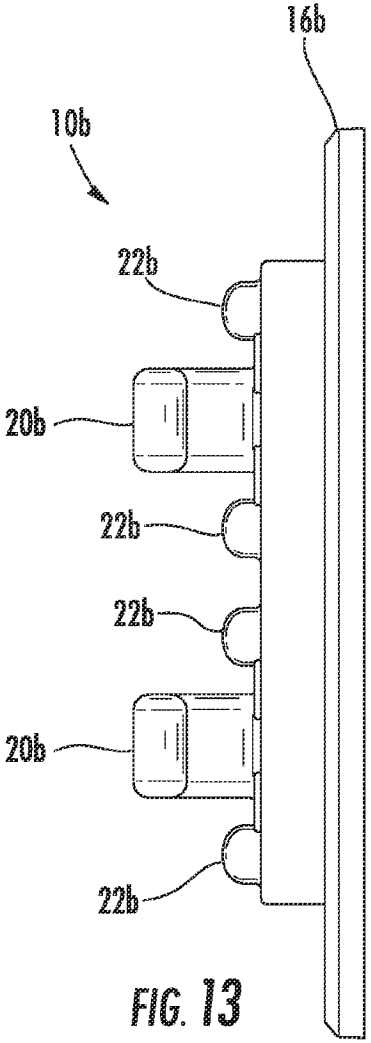
FIG. 13 is a left side elevational view of the outlet cover of FIG. 9.
Figure 12:
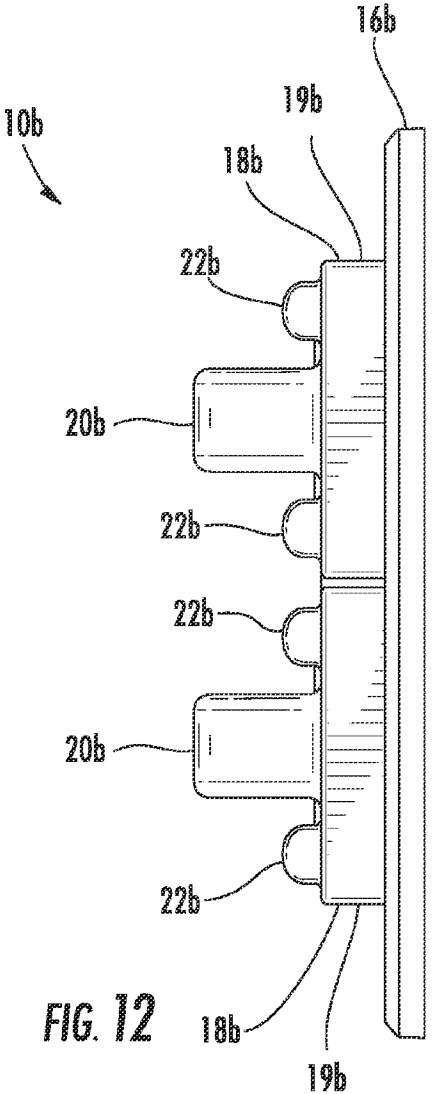
FIG. 12 is a right side elevational view of the outlet cover of FIG. 9.
Figure 14:
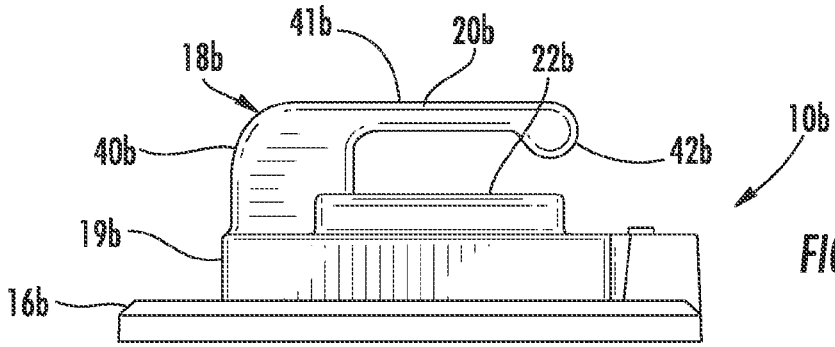
FIG. 14 is a top plan view of the outlet cover of FIG. 9.
Figure 14A:
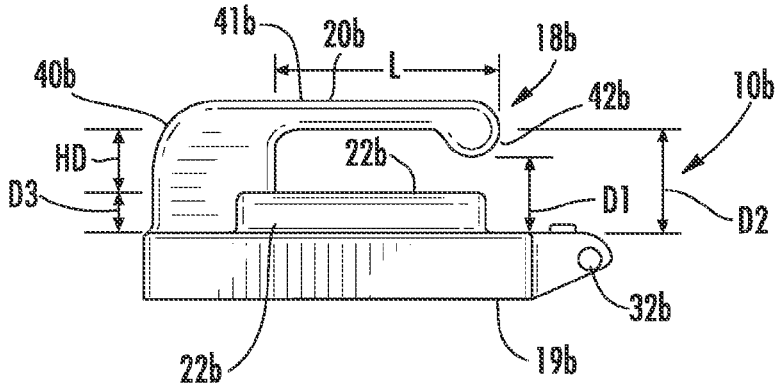
FIG. 14A is a top plan detail view showing only the lid of the outlet cover of FIG. 9.
Figure 15:
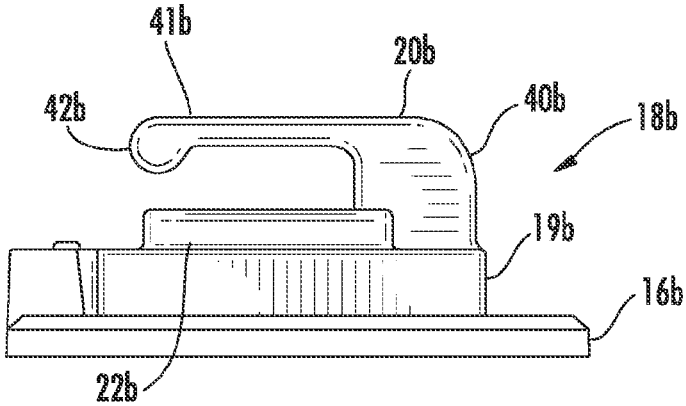
FIG. 15 is a bottom plan view of the outlet cover of FIG. 9.
Figure 15A:
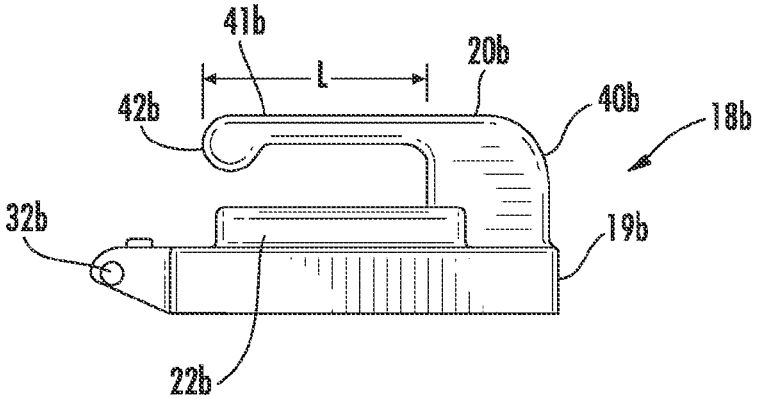
FIG. 15A is a bottom plan detail view showing only the lid of the outlet cover of FIG. 9.
Figure 16:
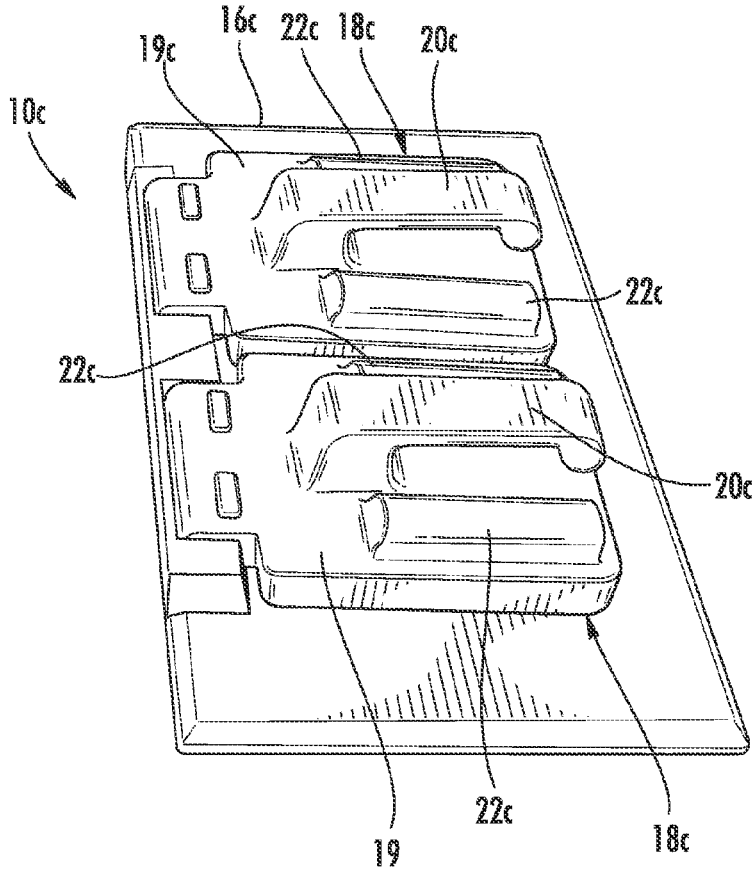
FIG. 16 is a perspective view of another alternative power cord securing outlet cover, having a rightwardly directed prong and suitable for application with a standard electrical outlet, in accordance with an alternative embodiment of the present invention.
Figure 17:
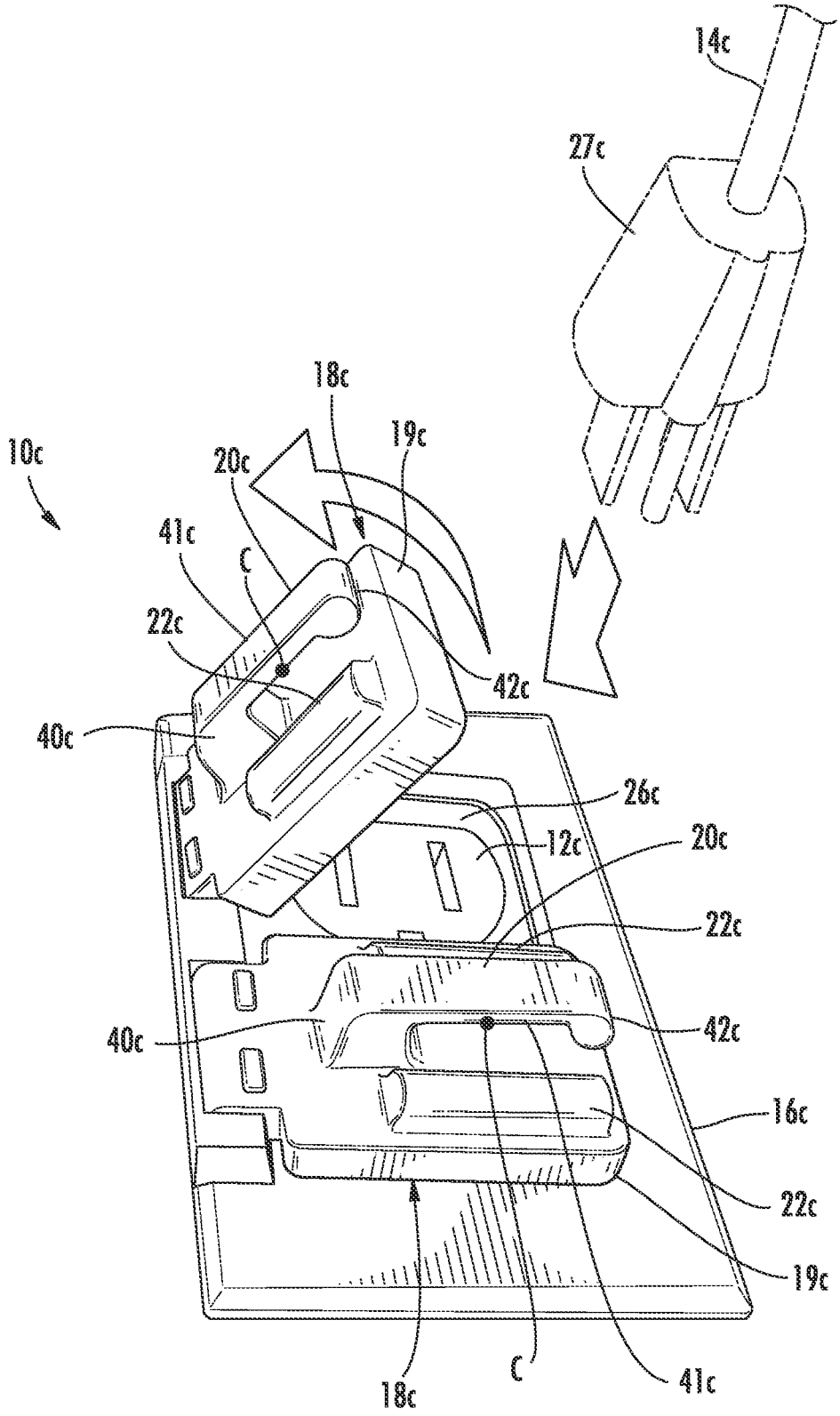
FIGS. 17-19 is a perspective view of the outlet cover of FIG. 16, showing a method of attaching an electrical power cord to the outlet cover.
Figure 19:
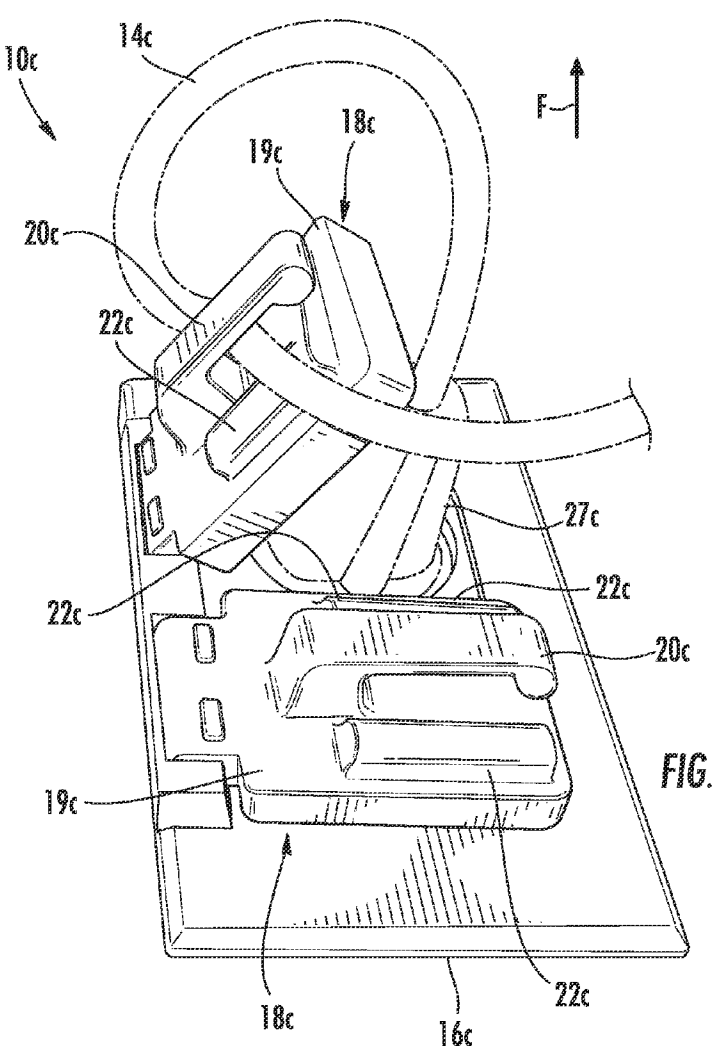
Figure 18:
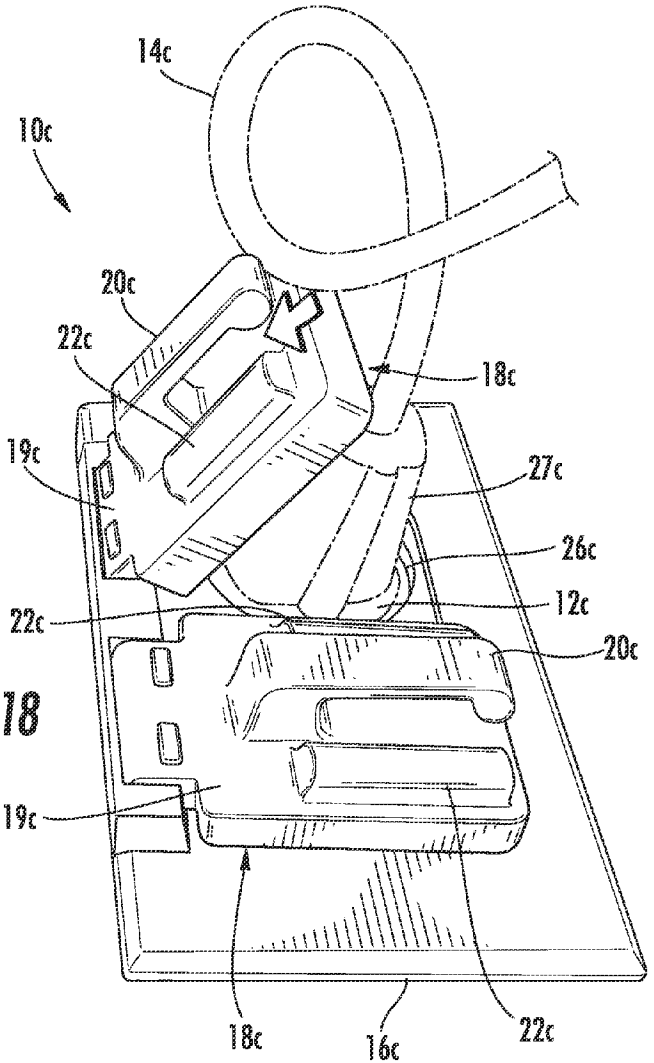
Figure 21:
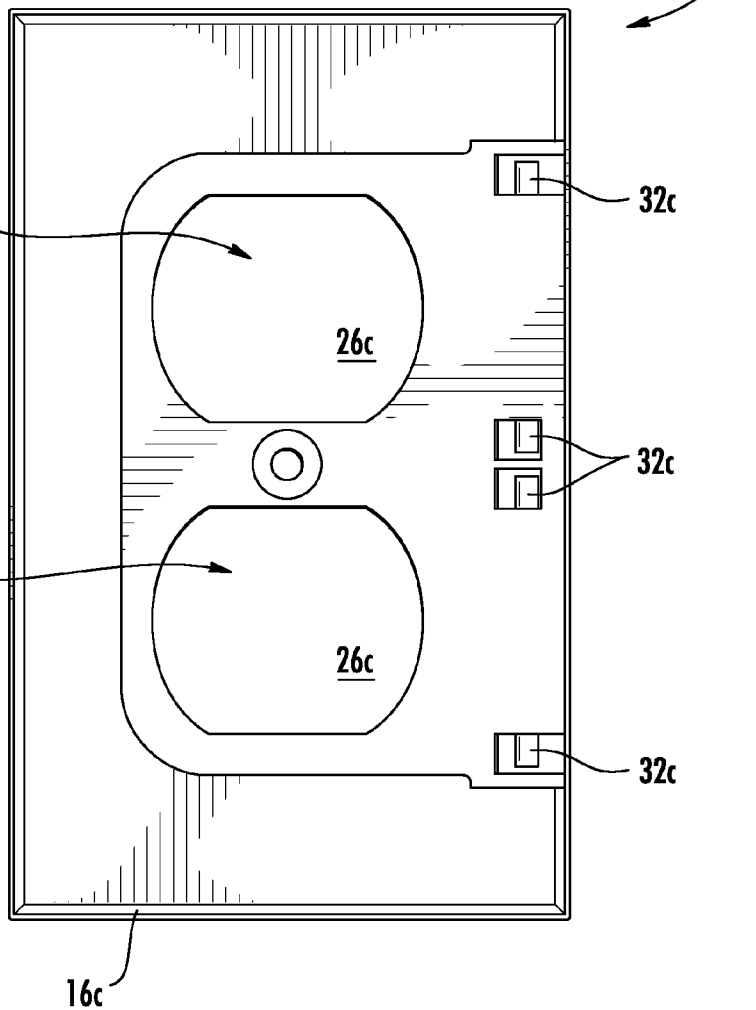
FIG. 21 is a rear elevational view of the outlet cover of FIG. 16.
Figure 20:
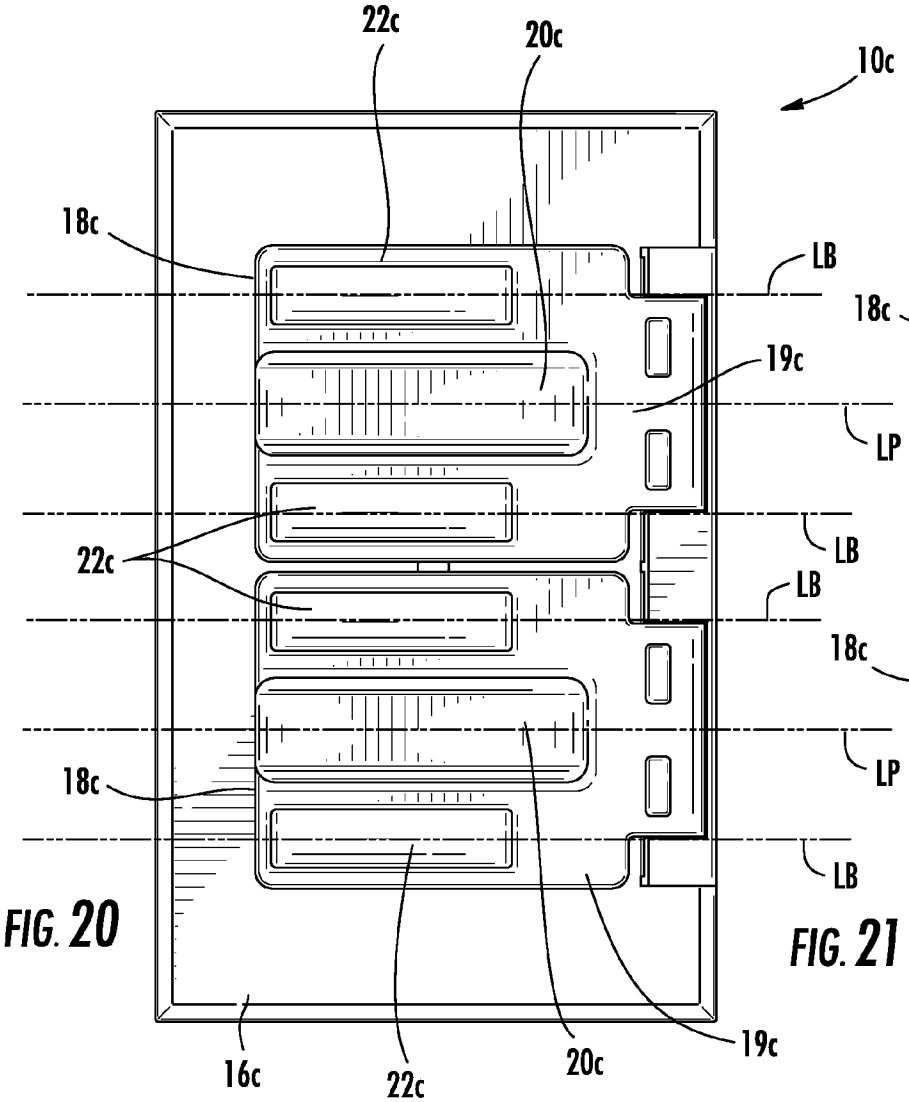
FIG. 20 is a front elevational view of the outlet cover of FIG. 16.
Figure 22:
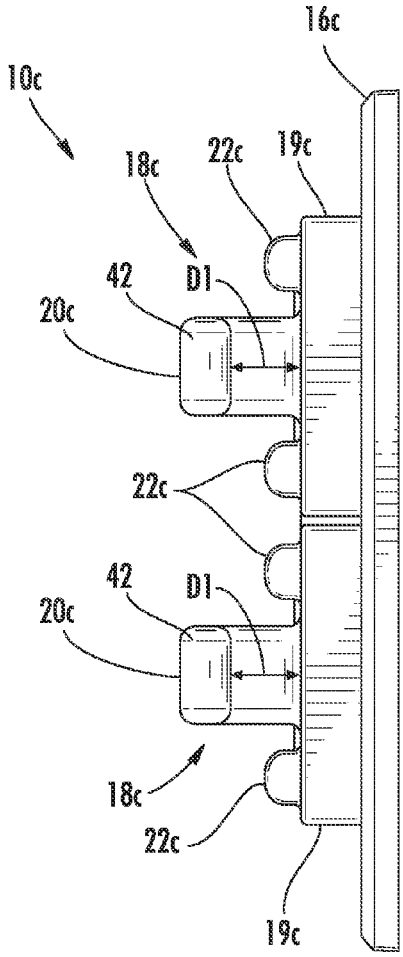
FIG. 22 is a right side elevational view of the outlet cover of FIG. 16.
Figure 23:
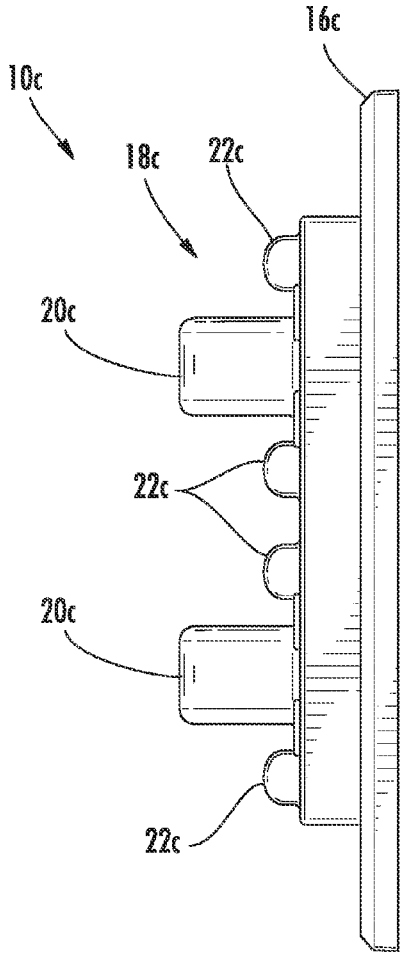
FIG. 23 is a left side elevational view of the outlet cover of FIG. 16.
Figure 24:
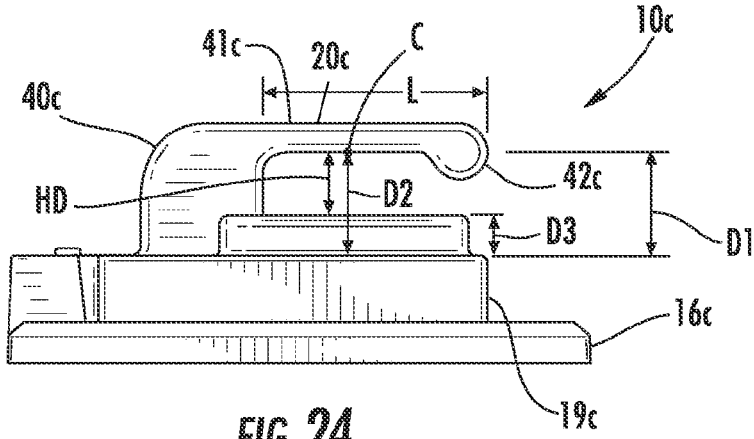
FIG. 24 is a bottom plan view of the outlet cover of FIG. 16.
Figure 25:
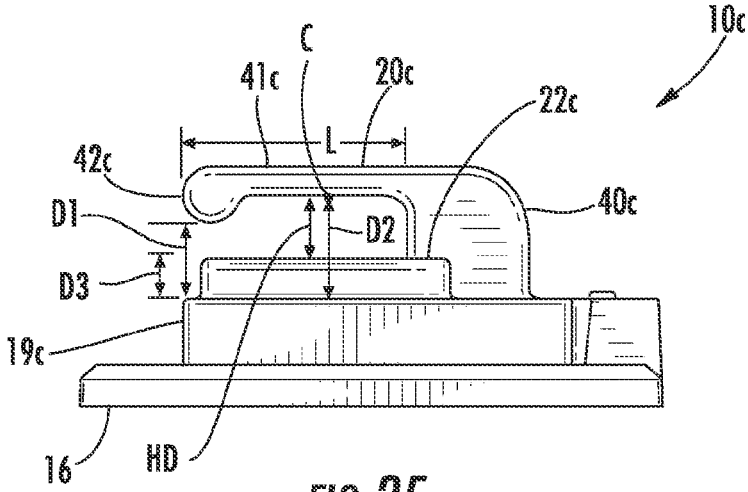
FIG. 25 is a top plan view of the outlet cover of FIG. 16.
Figure 26:
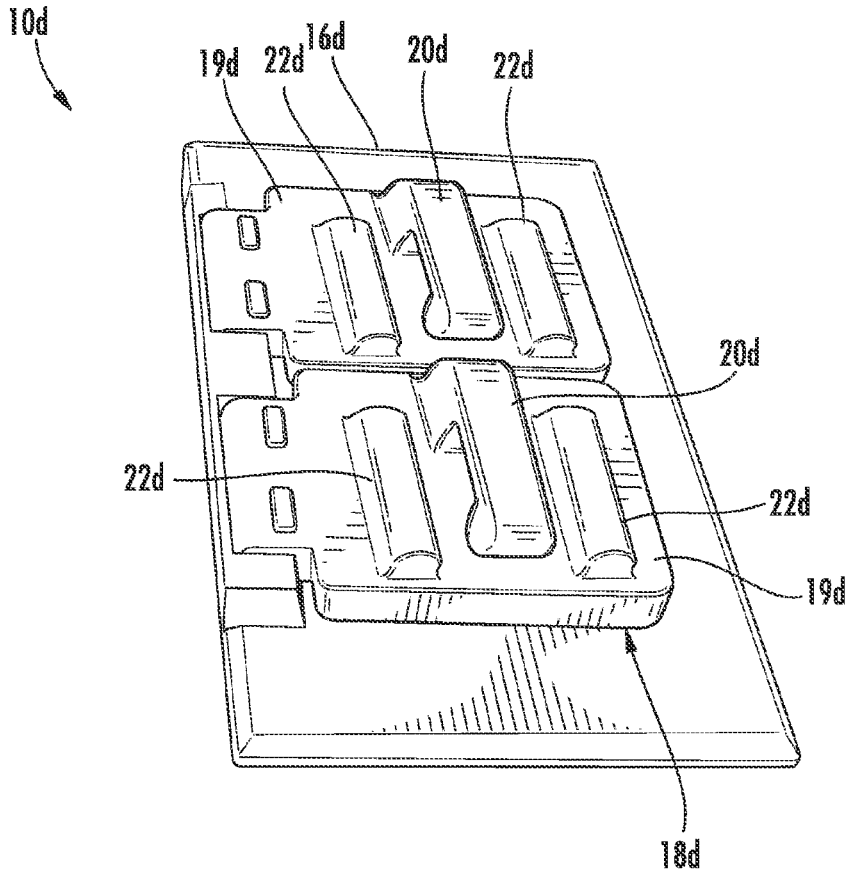
FIG. 26 is a perspective view of still another alternative power cord securing outlet cover, having a downwardly directed prong and suitable for application with a standard electrical outlet, in accordance with an alternative embodiment of the present invention.
Figure 27:
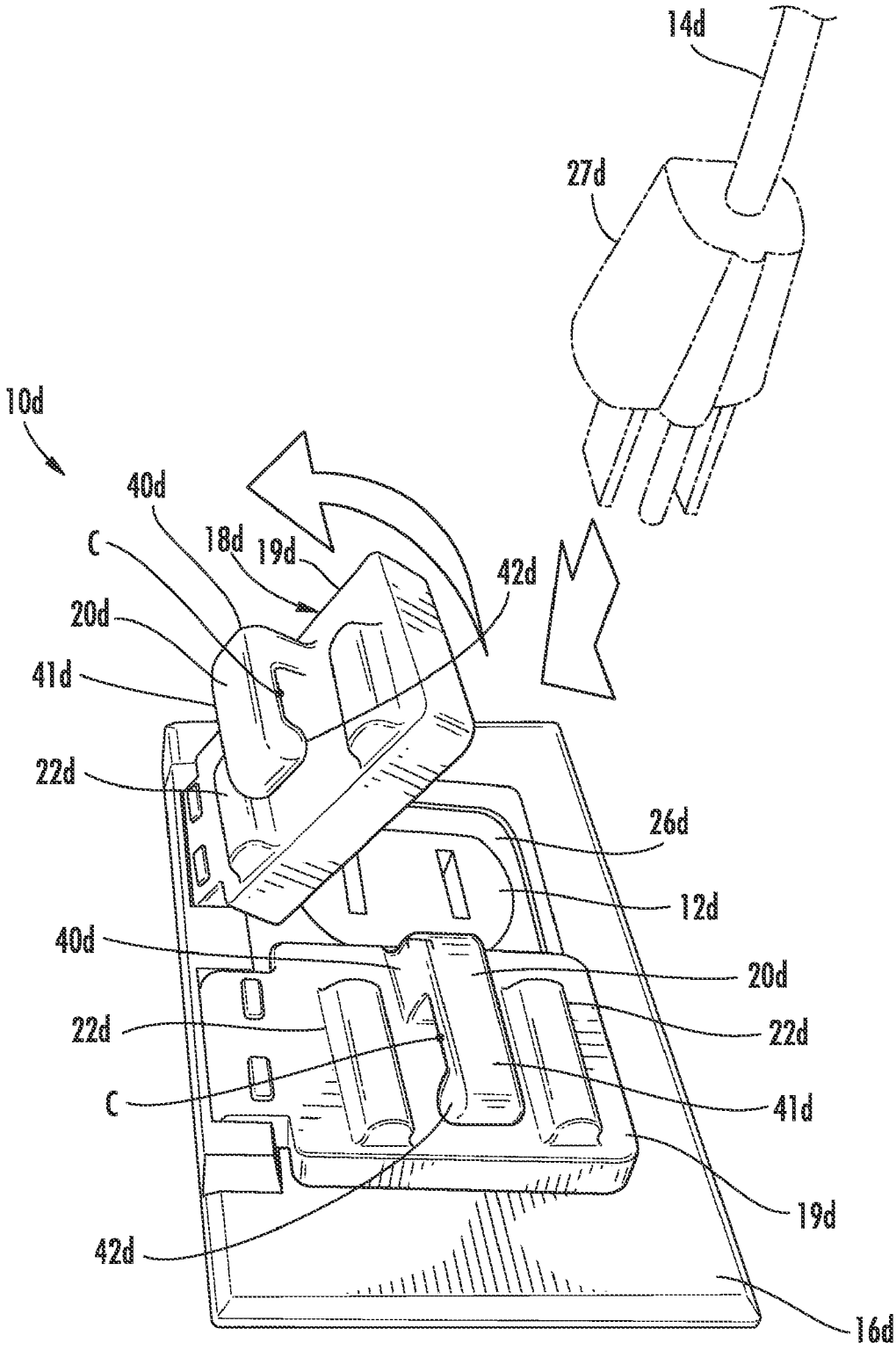
FIGS. 27-29 is a perspective view of the outlet cover of FIG. 26, showing a method of attaching an electrical power cord to the outlet cover.
Figure 29:
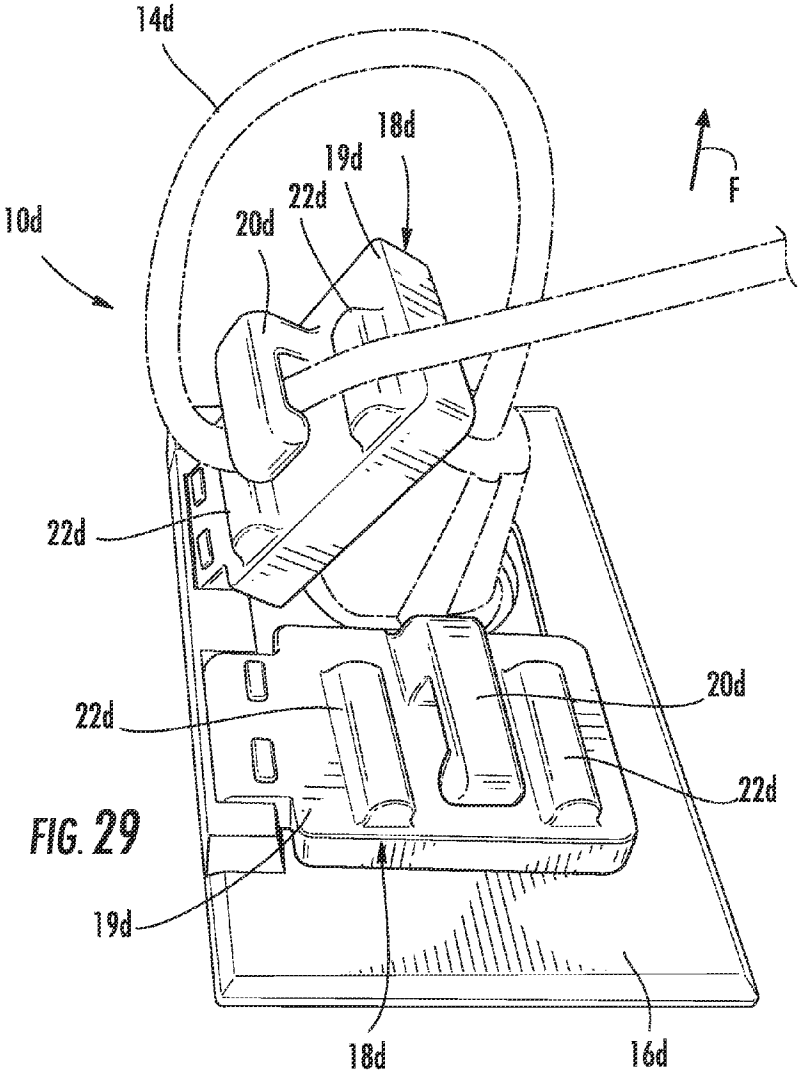
Figure 28:
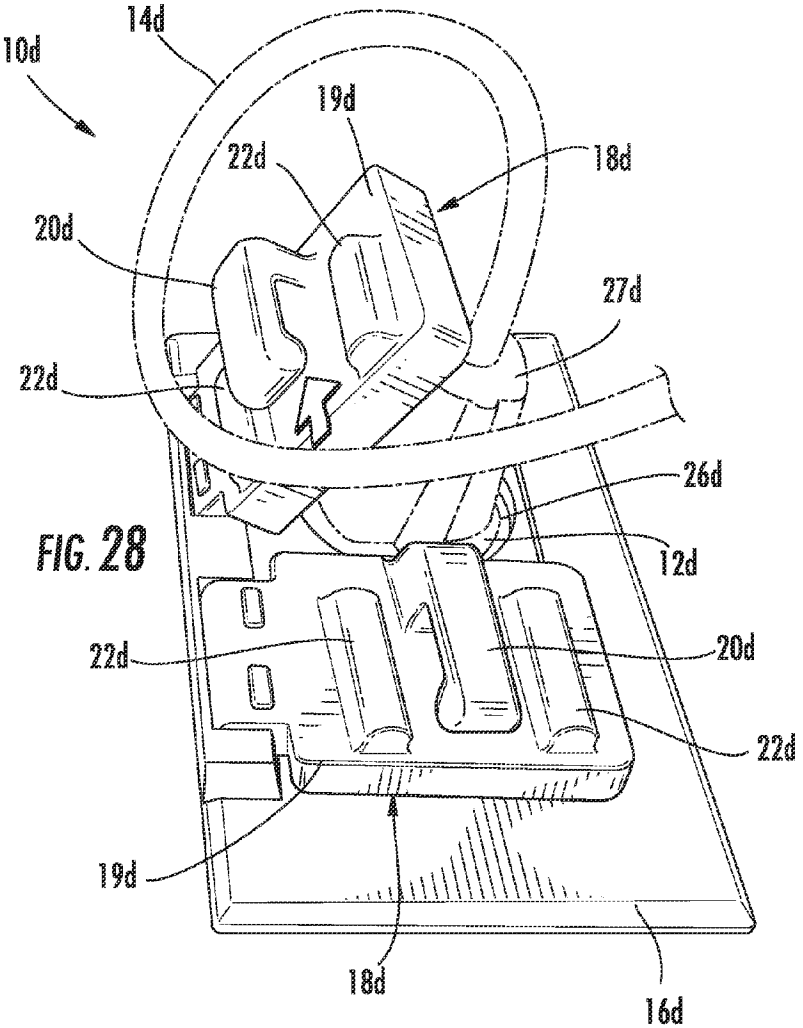
Figure 31:
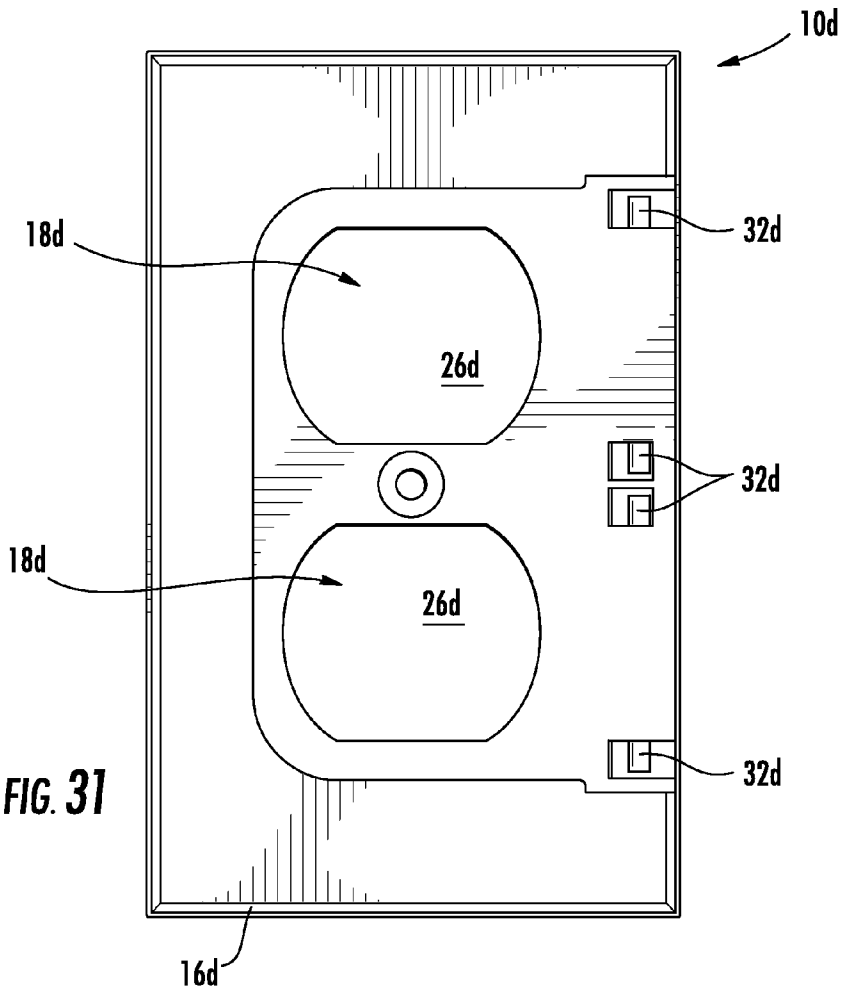
FIG. 31 is a rear elevational view of the outlet cover of FIG. 26.
Figure 30:
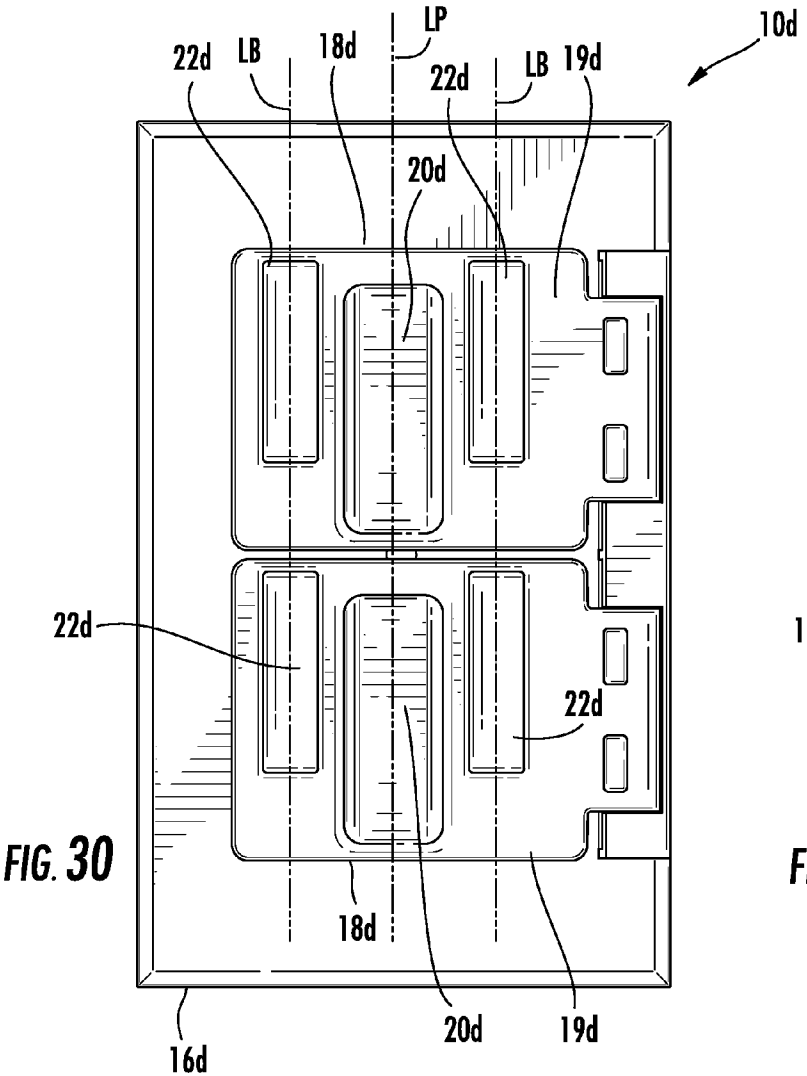
FIG. 30 is a front elevational view of the outlet cover of FIG. 26.
Figure 32:
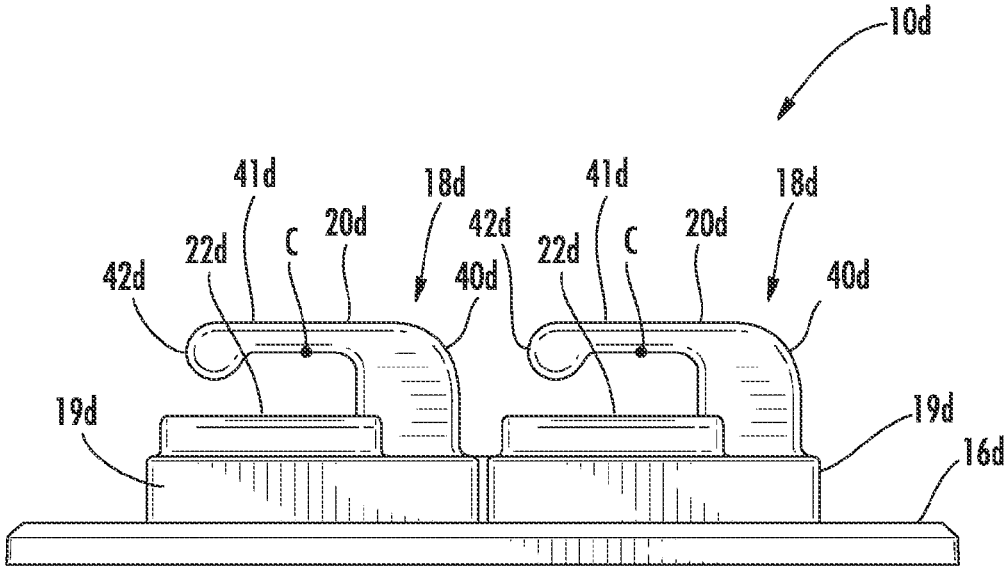
FIG. 32 is a right side elevational view of the outlet cover of FIG. 26.
Figure 33:
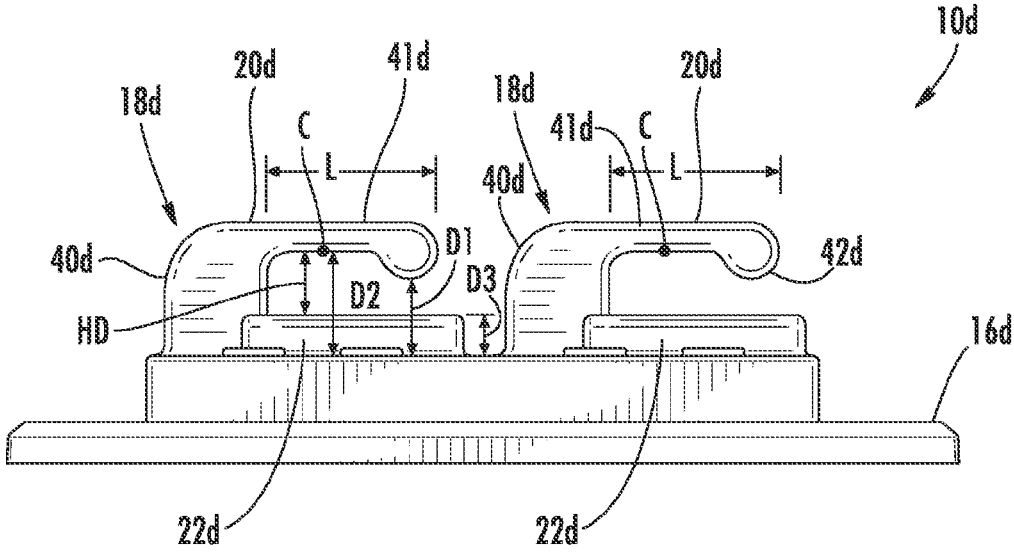
FIG. 33 is a left side elevational view of the outlet cover of FIG. 26.
Figure 34:
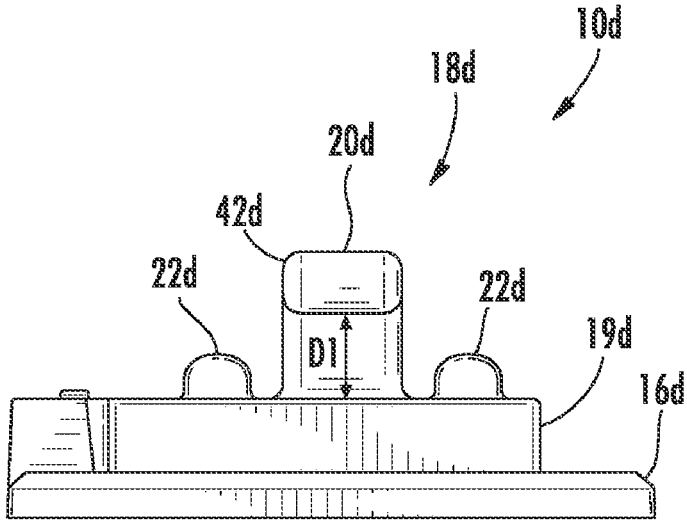
FIG. 34 is a bottom plan view of the outlet cover of FIG. 26.
Figure 35:
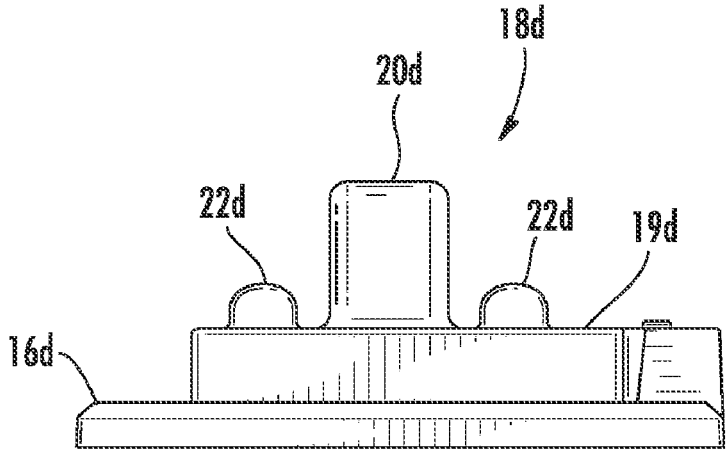
FIG. 35 is a top plan view of the outlet cover of FIG. 26.
Figure 36:
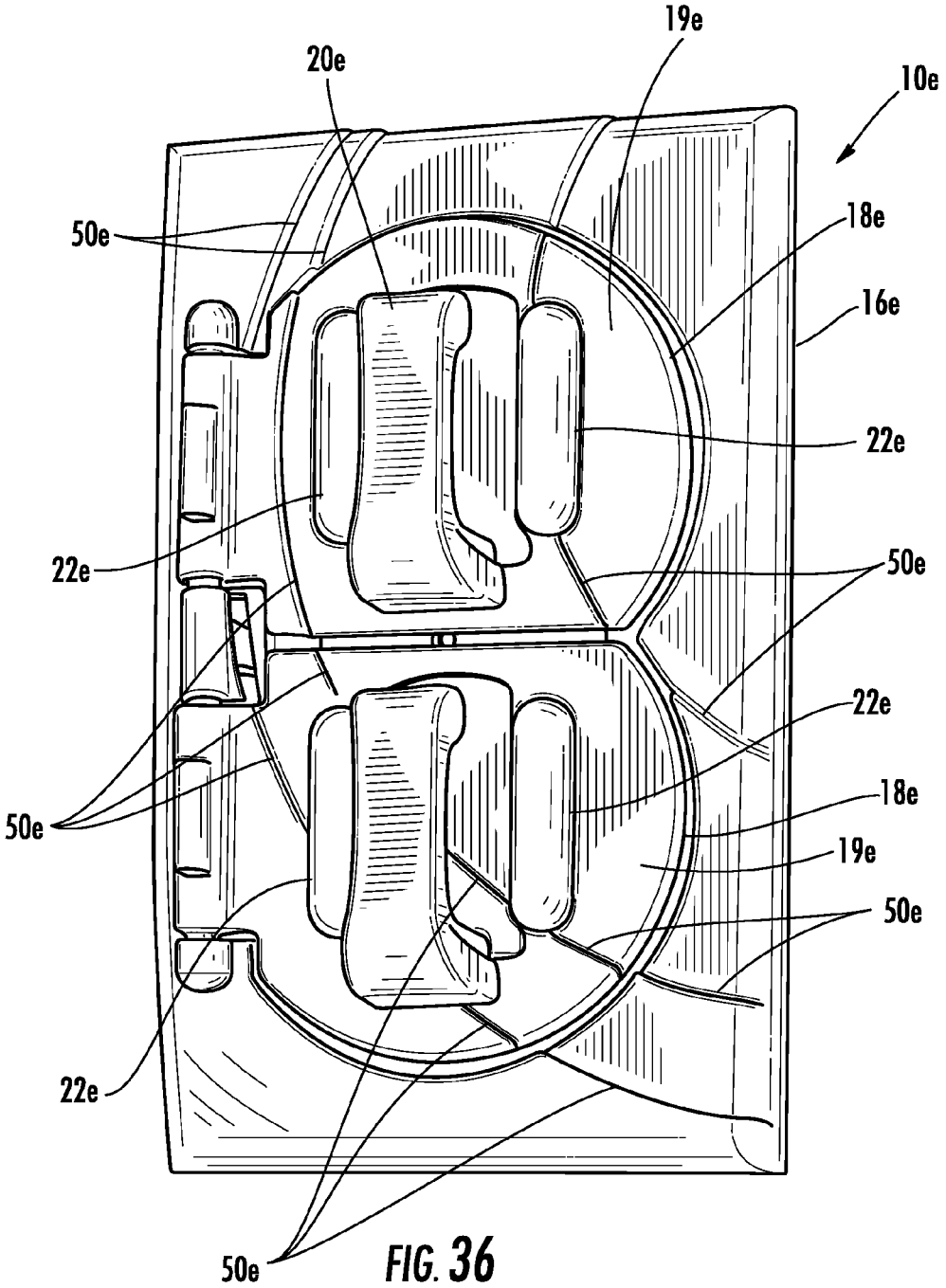
FIG. 36 is a perspective view of another power cord securing outlet cover that is functionally similar to the embodiment illustrated by FIGS. 1-7A, having an upwardly directed prong and being suitable for application with a standard electrical outlet, but further having designer features in accordance with an embodiment of the present invention.
Figure 37:
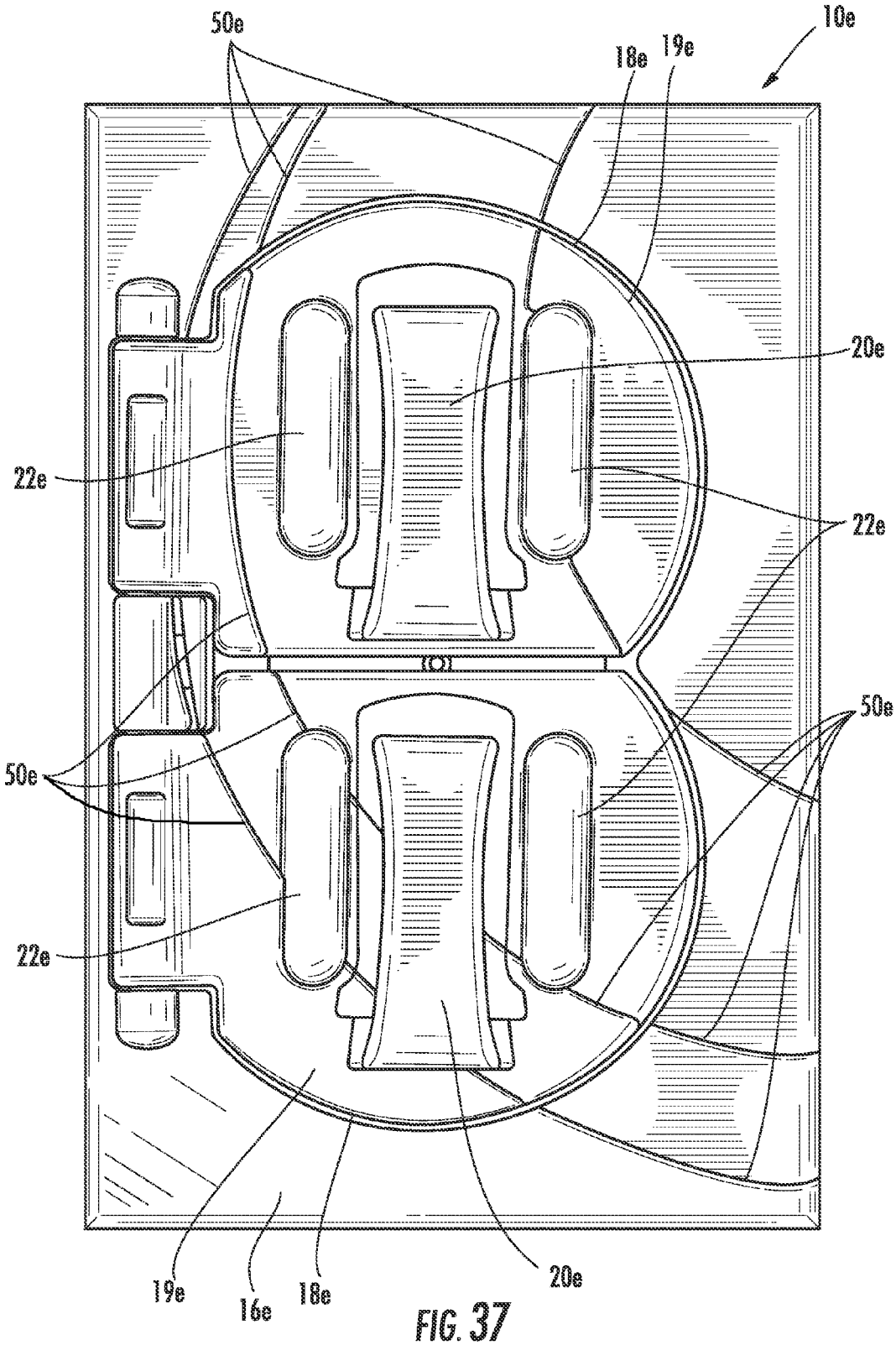
FIG. 37 is a front elevational view of the outlet cover of FIG. 36.
Figure 38:
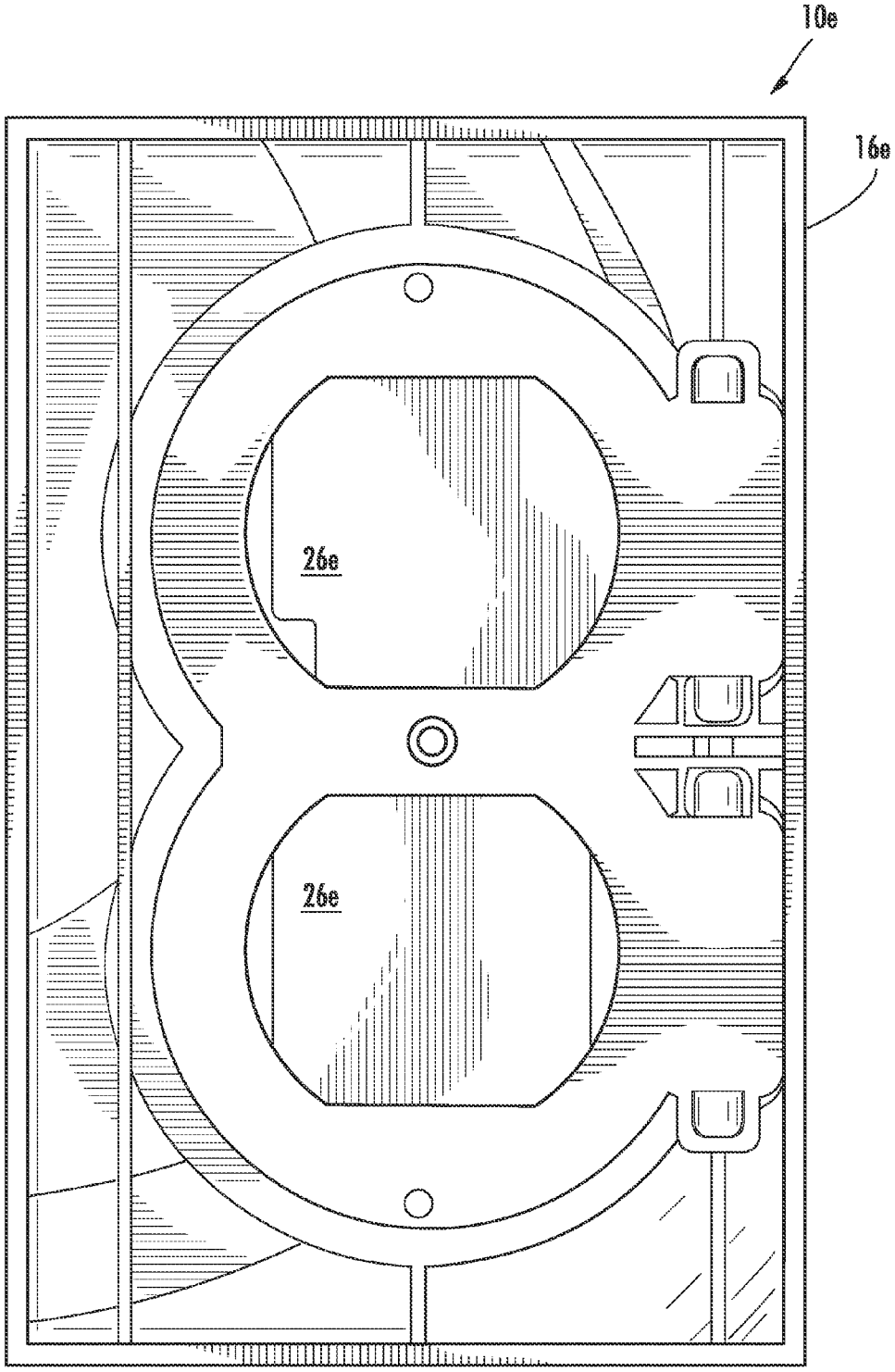
FIG. 38 is a rear elevational view of the outlet cover of FIG. 36.
Figure 39:
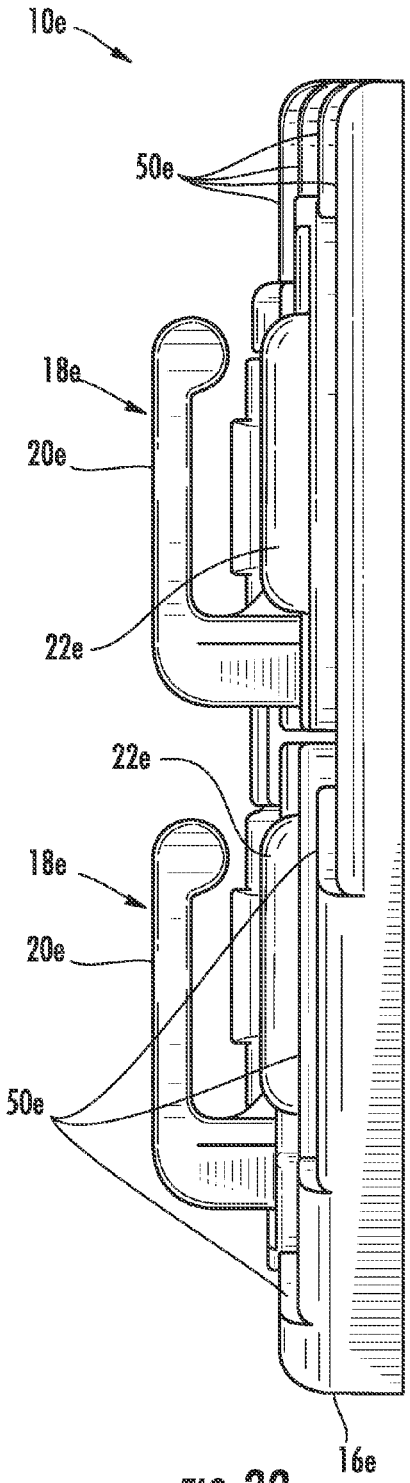
FIG. 39 is a right side elevational view of the outlet cover of FIG. 36.
Figure 40:
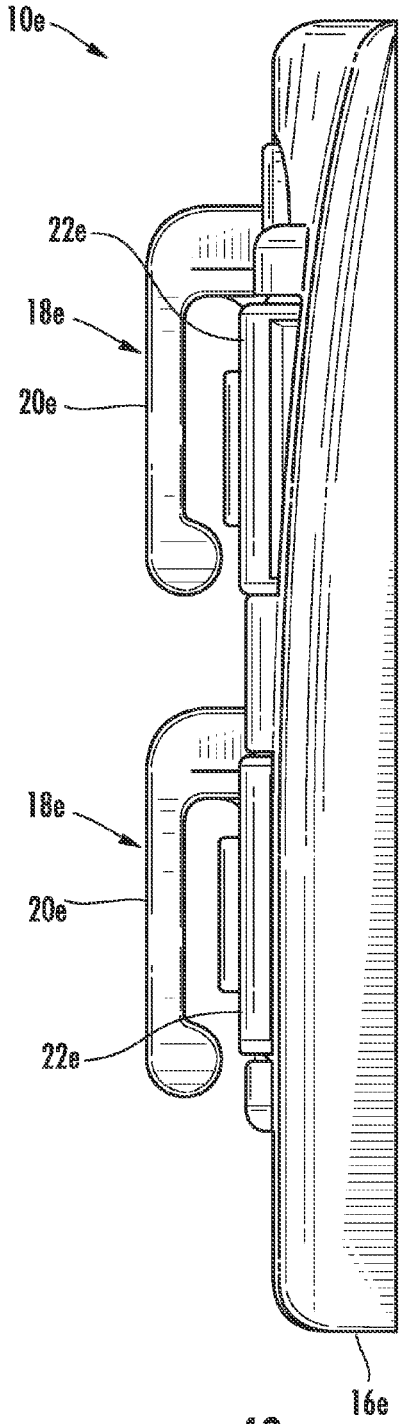
FIG. 40 is a left side elevational view of the outlet cover of FIG. 36.
Figure 41:
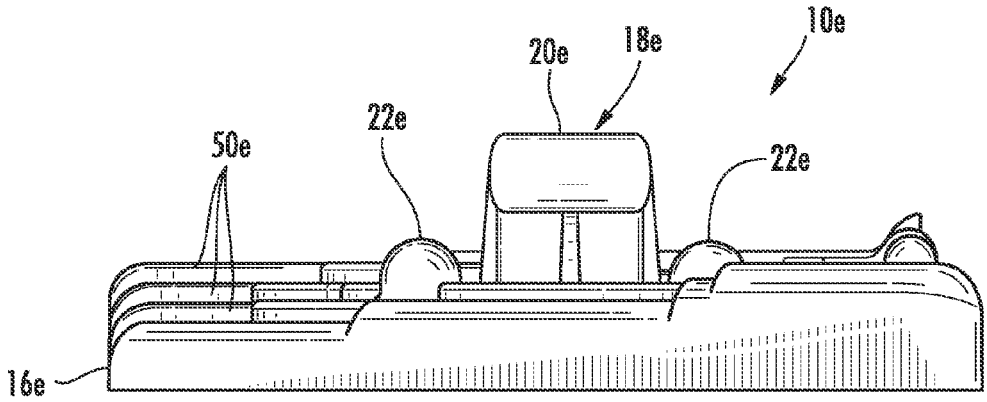
FIG. 41 is a top plan view of the outlet cover of FIG. 36.
Figure 42:
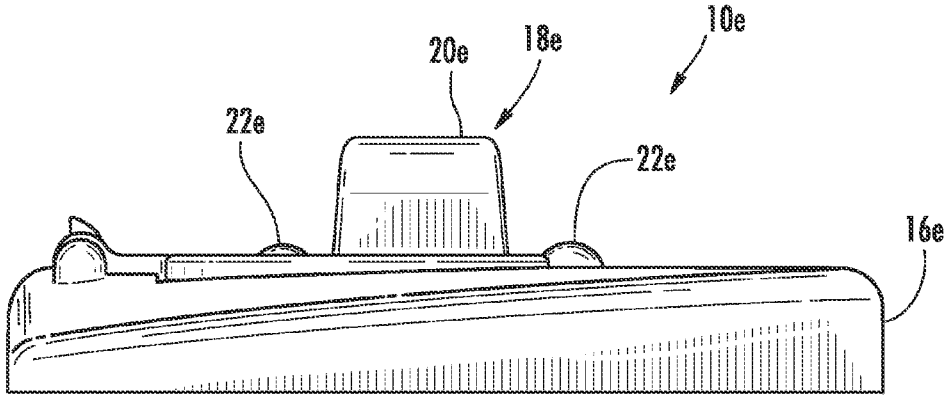
FIG. 42 is a bottom plan view of the outlet cover of FIG. 36.
Figure 43:
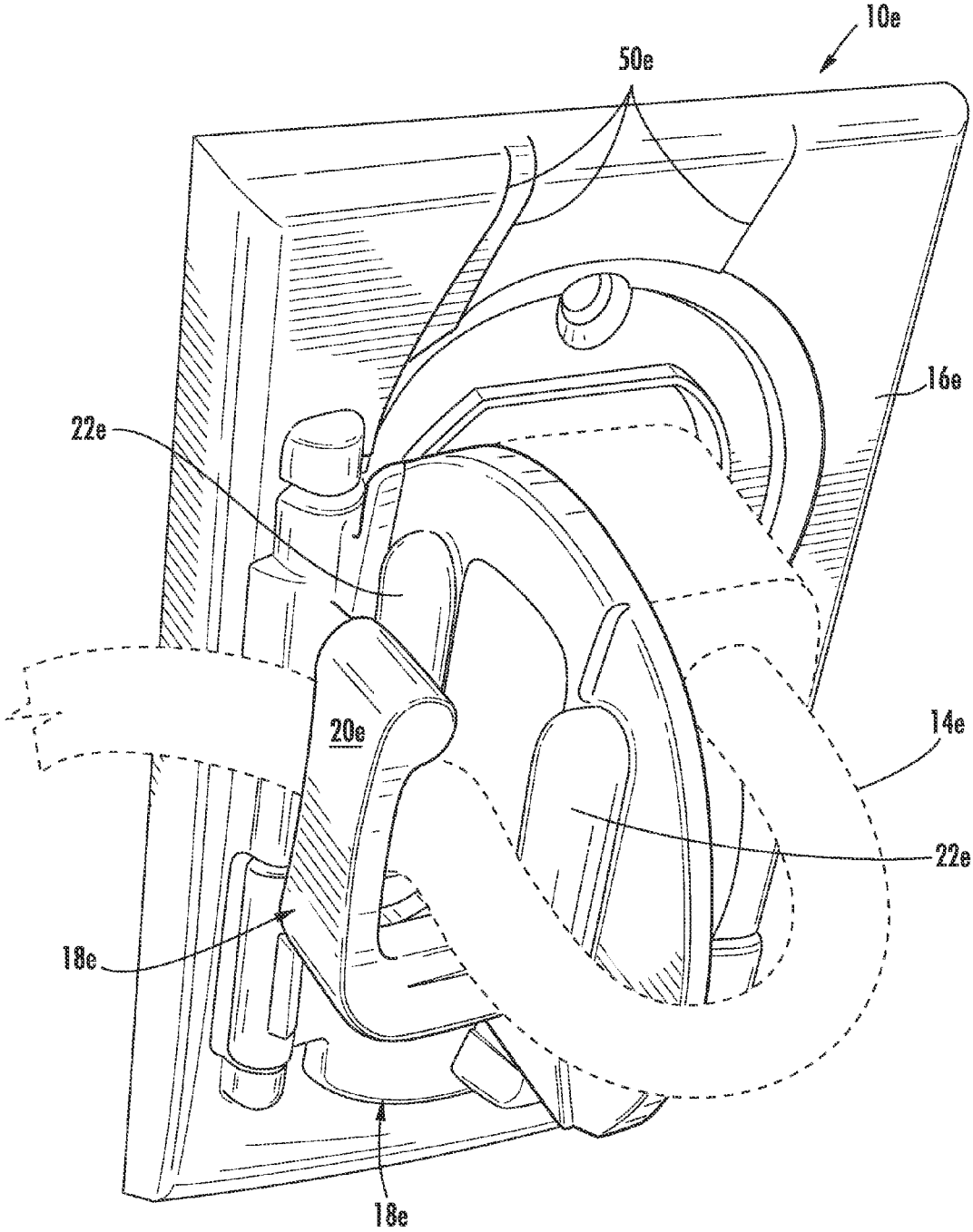
FIG. 43 is a perspective view of the outlet cover of FIG. 36, showing the outlet cover in use with a standard electrical outlet and securing a power cord from being inadvertently electrically disconnected from the outlet.
Figure 44:
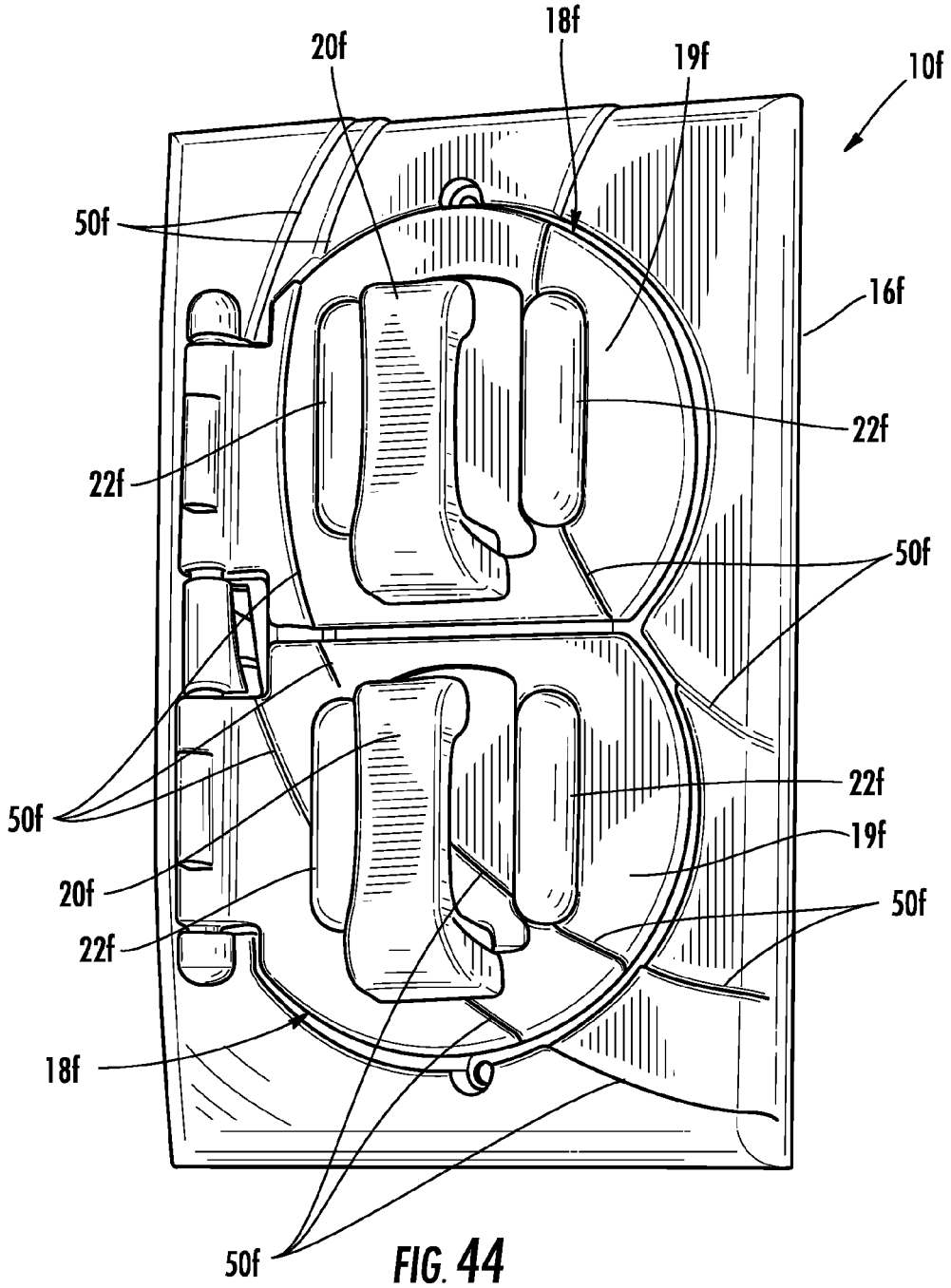
FIG. 44 is a perspective view of another power cord securing outlet cover that is functionally similar and having designer features that are similar to the embodiment illustrated by FIGS. 36-43, but being suitable for application with a GFI electrical outlet.
Figure 45:
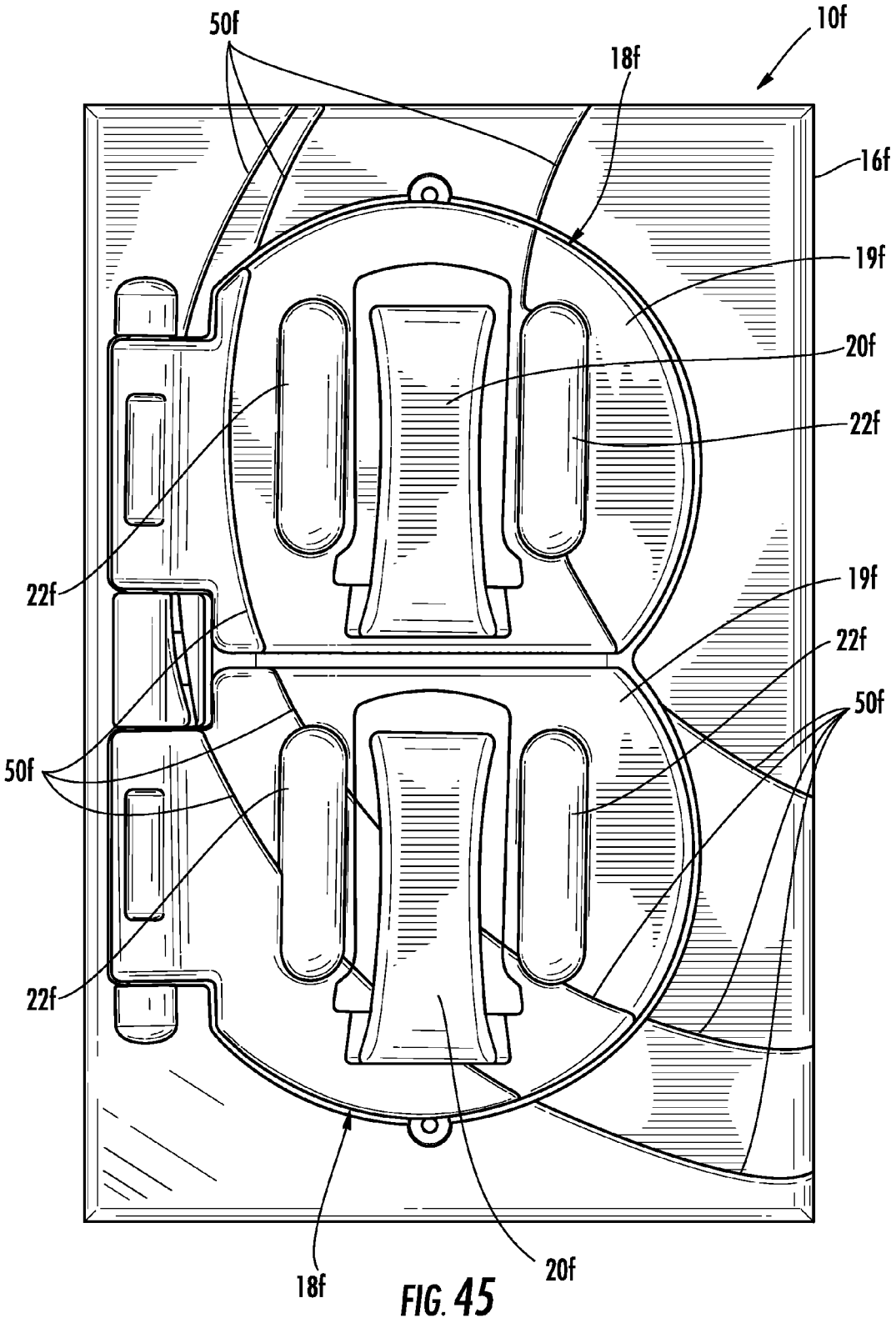
FIG. 45 is a front elevational view of the outlet cover of FIG. 44.
Figure 46:
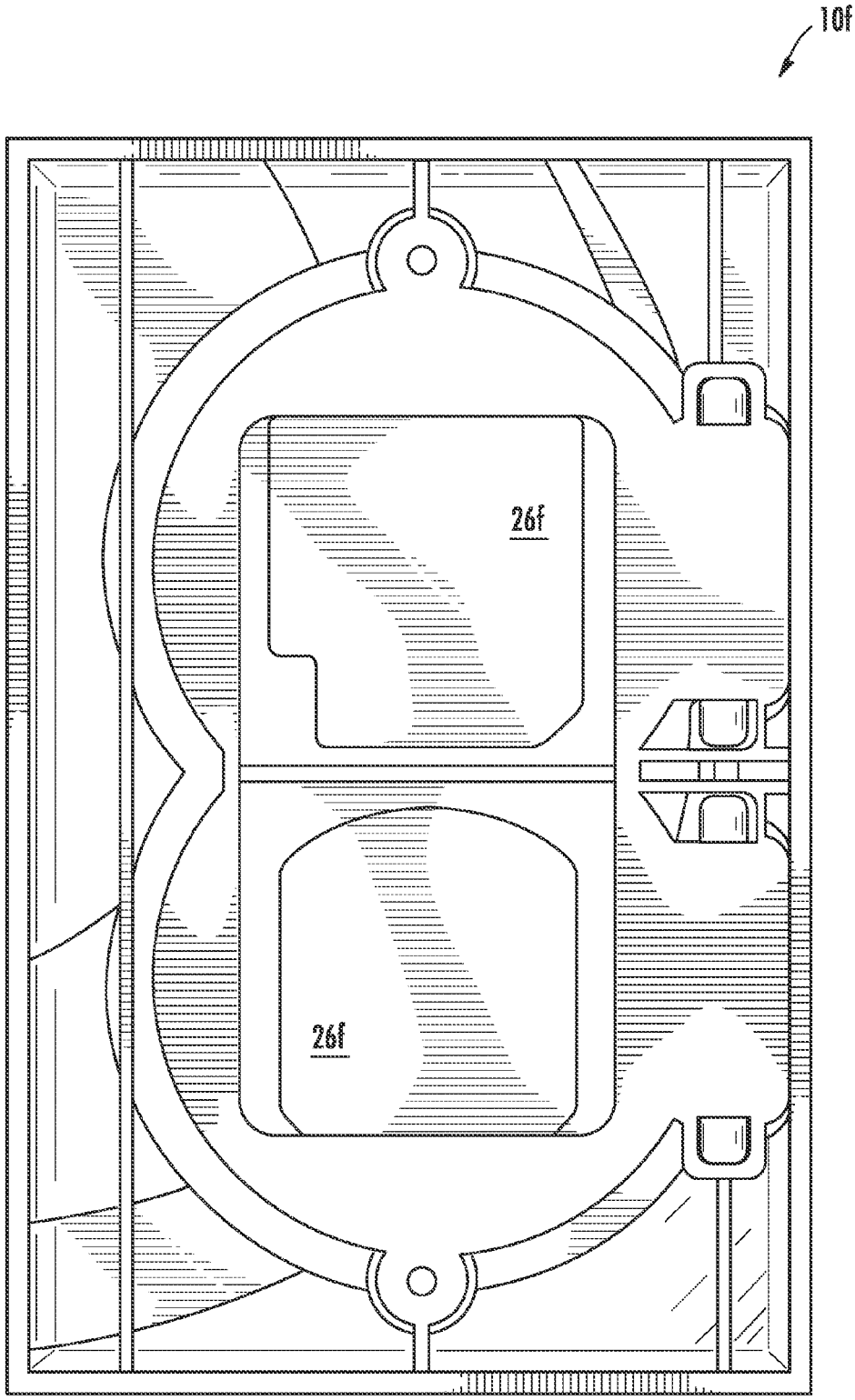
FIG. 46 is a rear elevational view of the outlet cover of FIG. 44.
Figure 47:
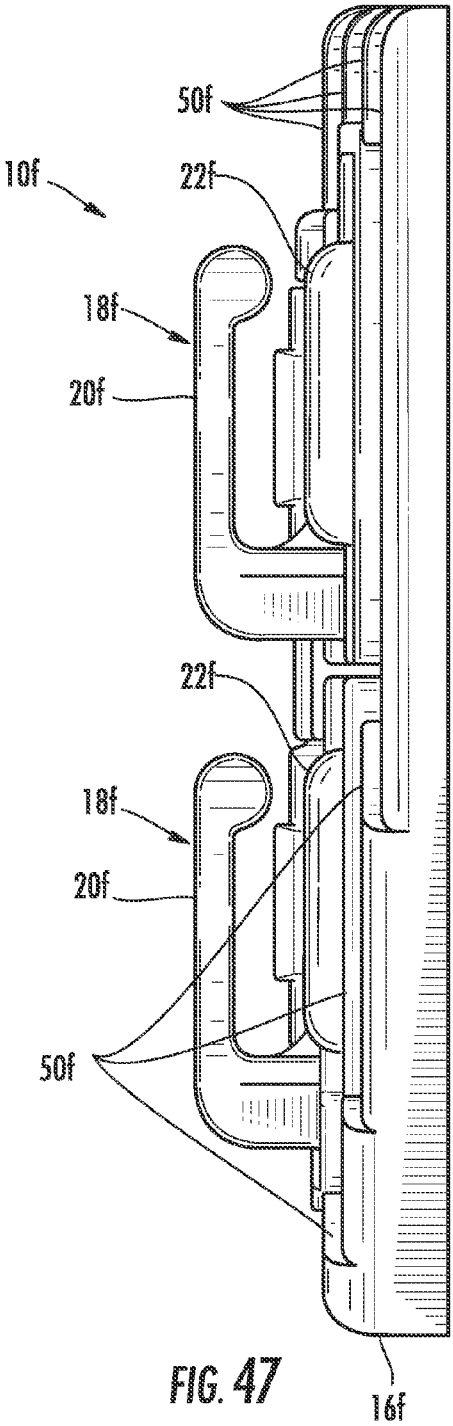
FIG. 47 is a right side elevational view of the outlet cover of FIG. 44.
Figure 48:
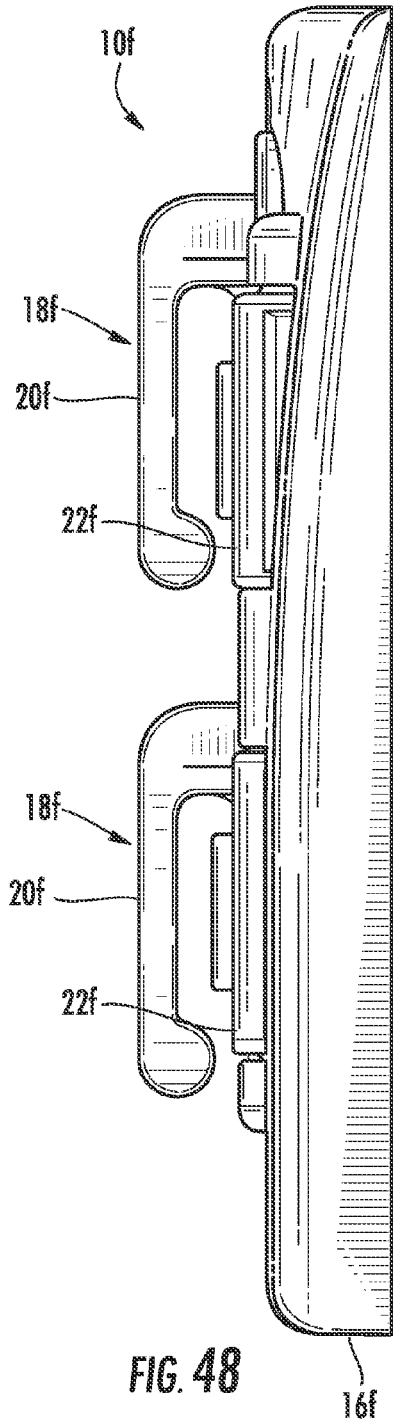
FIG. 48 is a left side elevational view of the outlet cover of FIG. 44.
Figure 49:
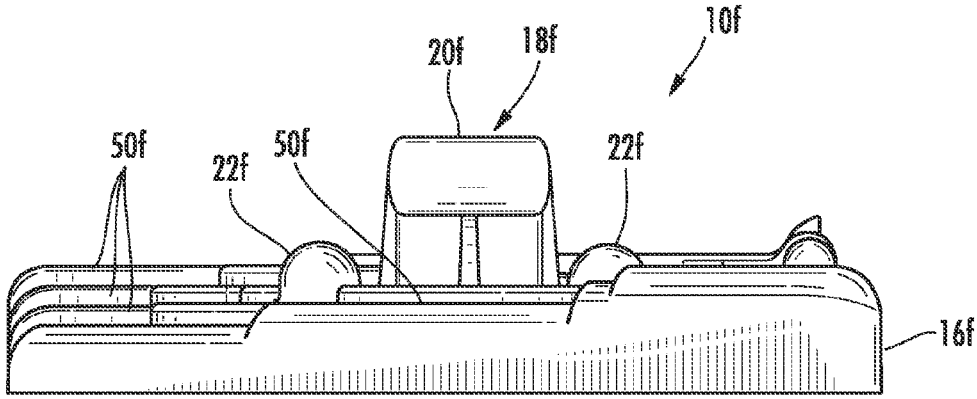
FIG. 49 is a top plan view of the outlet cover of FIG. 44.
Figure 50:
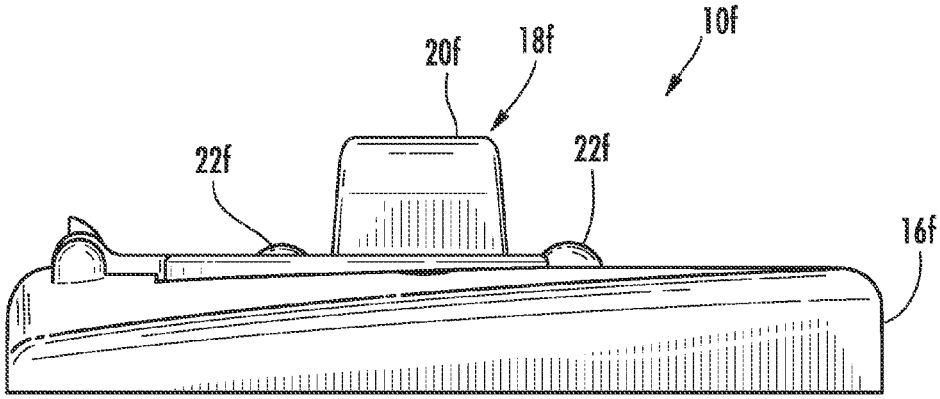
FIG. 50 is a bottom plan view of the outlet cover of FIG. 44.
Figure 51:
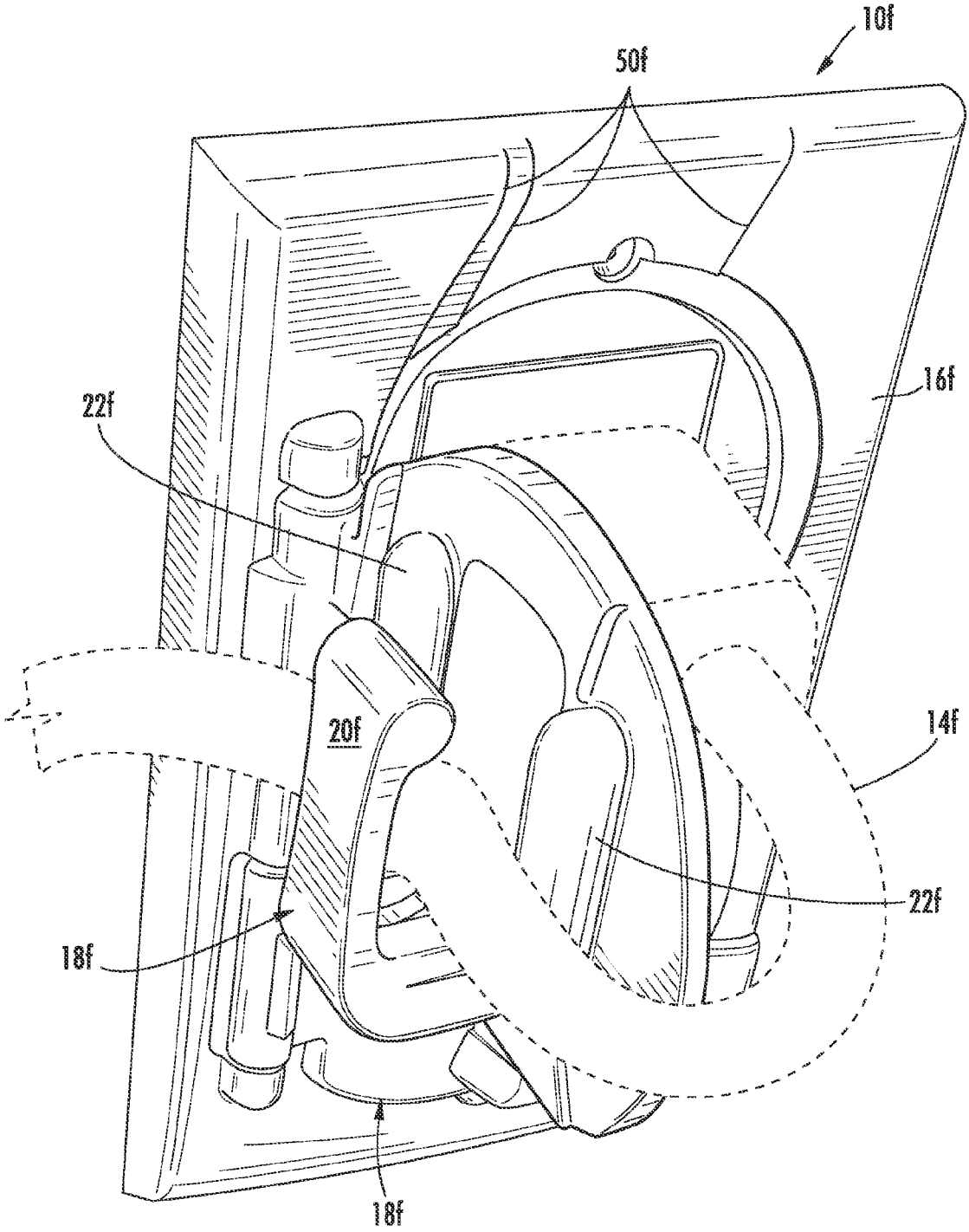
FIG. 51 is a perspective view of the outlet cover of FIG. 44, showing the outlet cover in use with a GFI electrical outlet and securing a power cord from being inadvertently electrically disconnected from the outlet.
Figure 52:
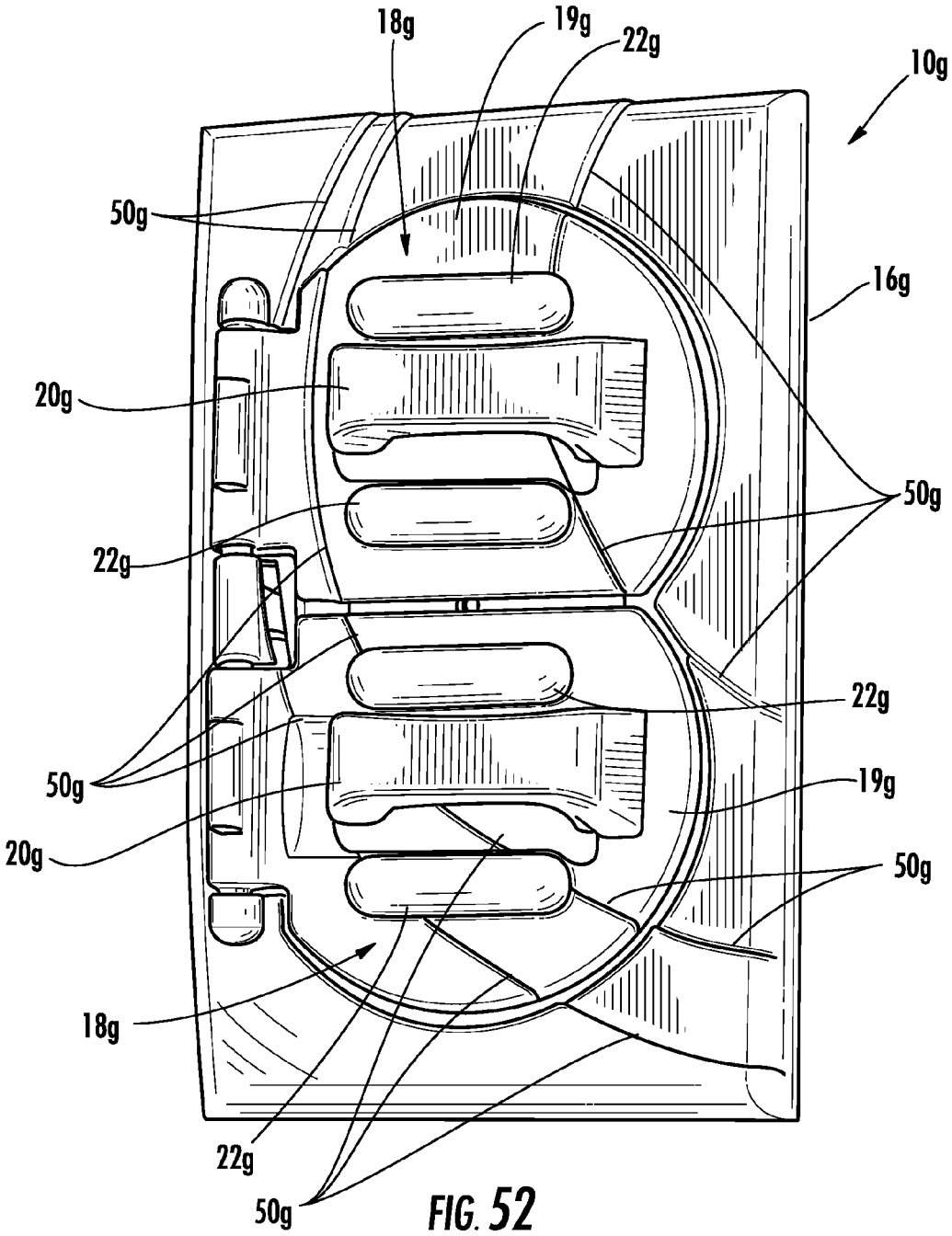
FIG. 52 is a perspective view of yet another power cord securing outlet cover that is functionally similar to the embodiment illustrated by FIGS. 9-15A, having a leftwardly directed prong and being suitable for application with a standard electrical outlet, but further having designer features in accordance with an embodiment of the present invention.
Figure 53:
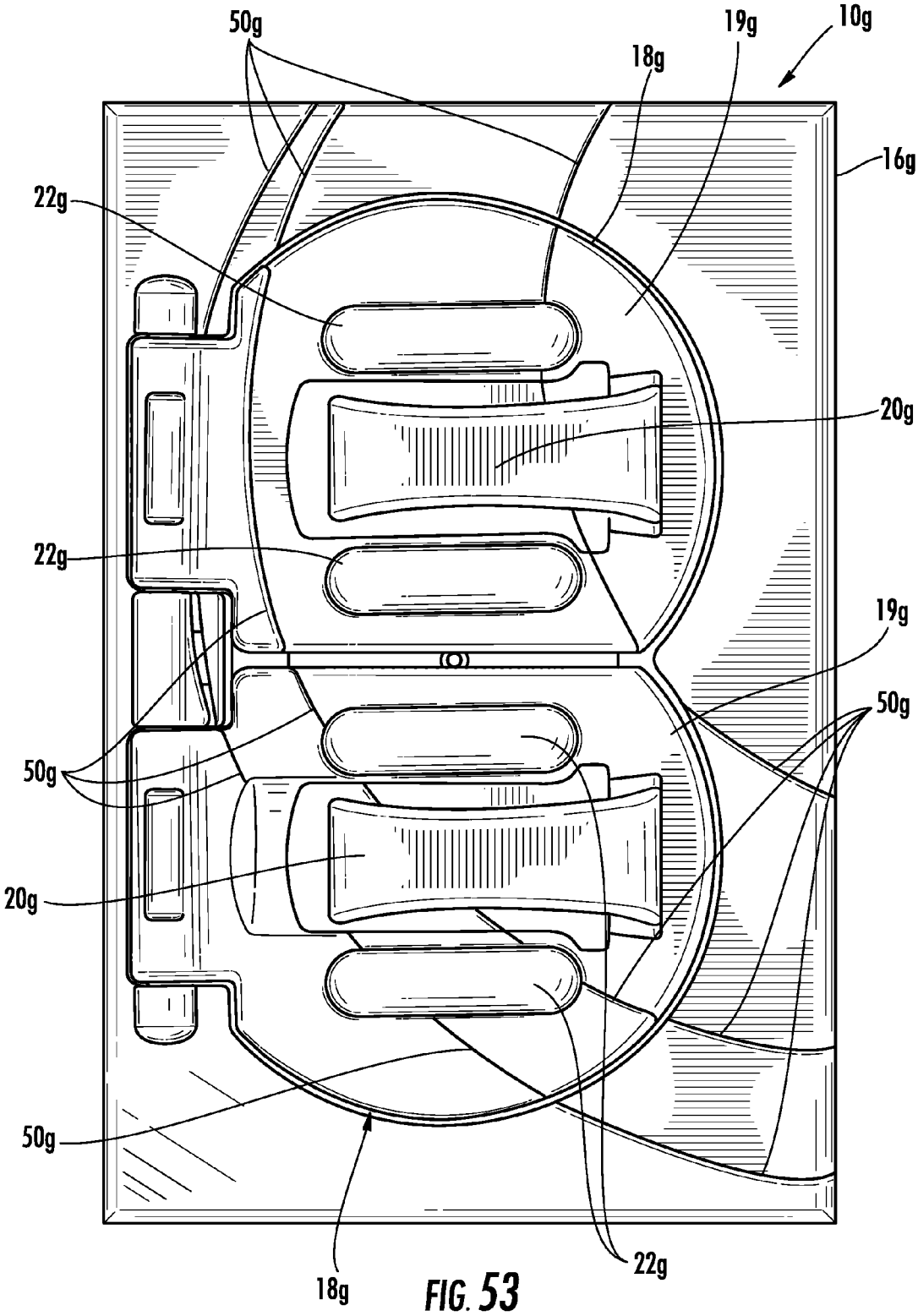
FIG. 53 is a front elevational view of the outlet cover of FIG. 52.
Figure 54:
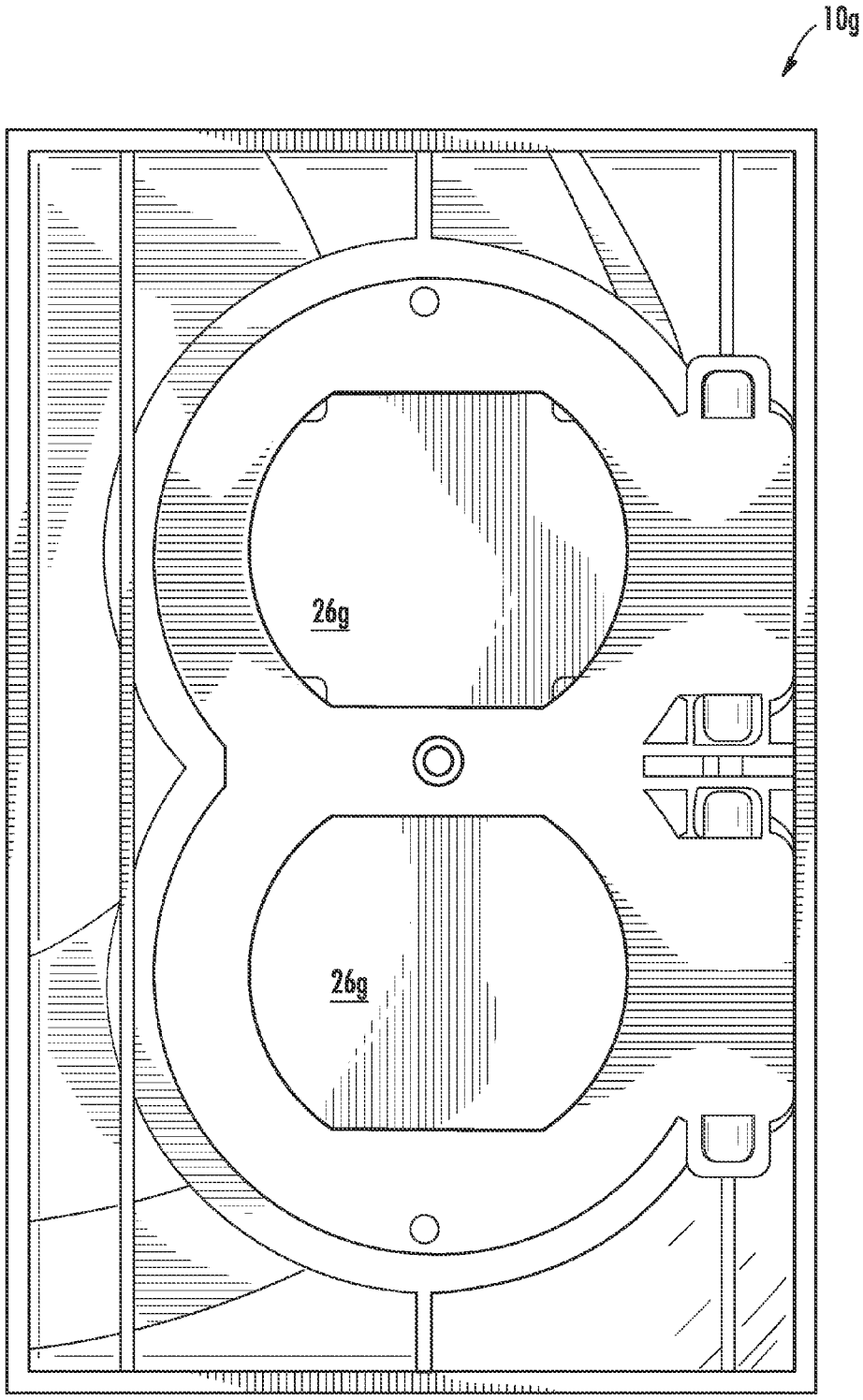
FIG. 54 is a rear elevational view of the outlet cover of FIG. 52.
Figure 55:
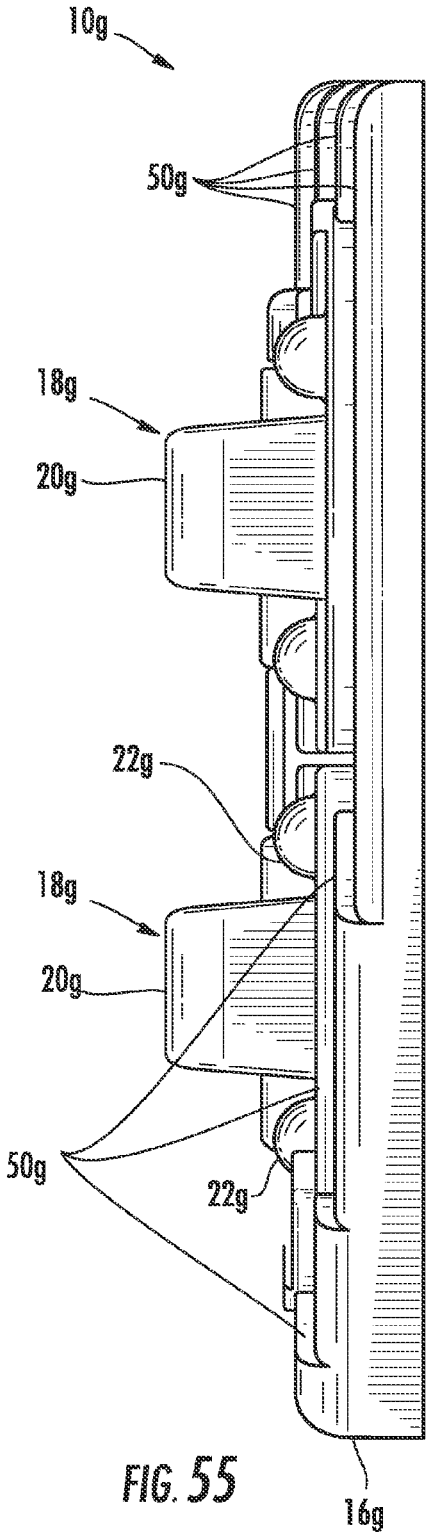
FIG. 55 is a right side elevational view of the outlet cover of FIG. 52.
Figure 56:
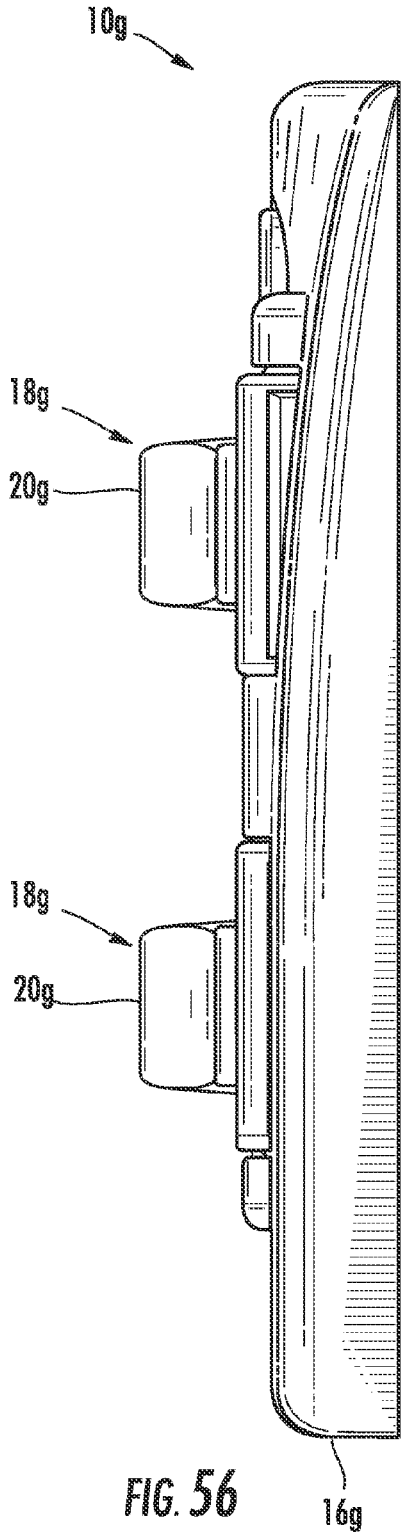
FIG. 56 is a left side elevational view of the outlet cover of FIG. 52.
Figure 57:
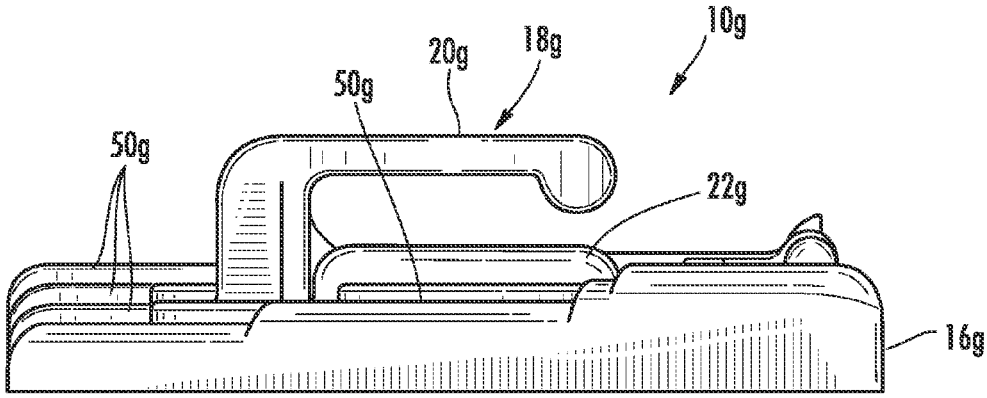
FIG. 57 is a top plan view of the outlet cover of FIG. 52.
Figure 58:
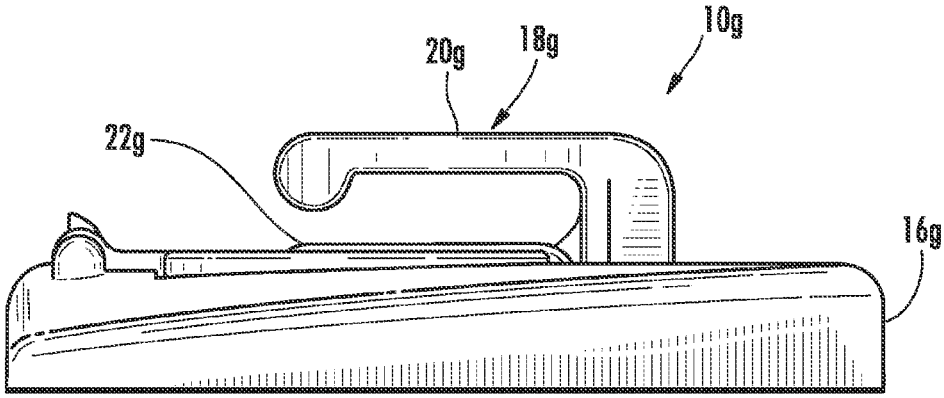
FIG. 58 is a bottom plan view of the outlet cover of FIG. 52.
Figure 59:
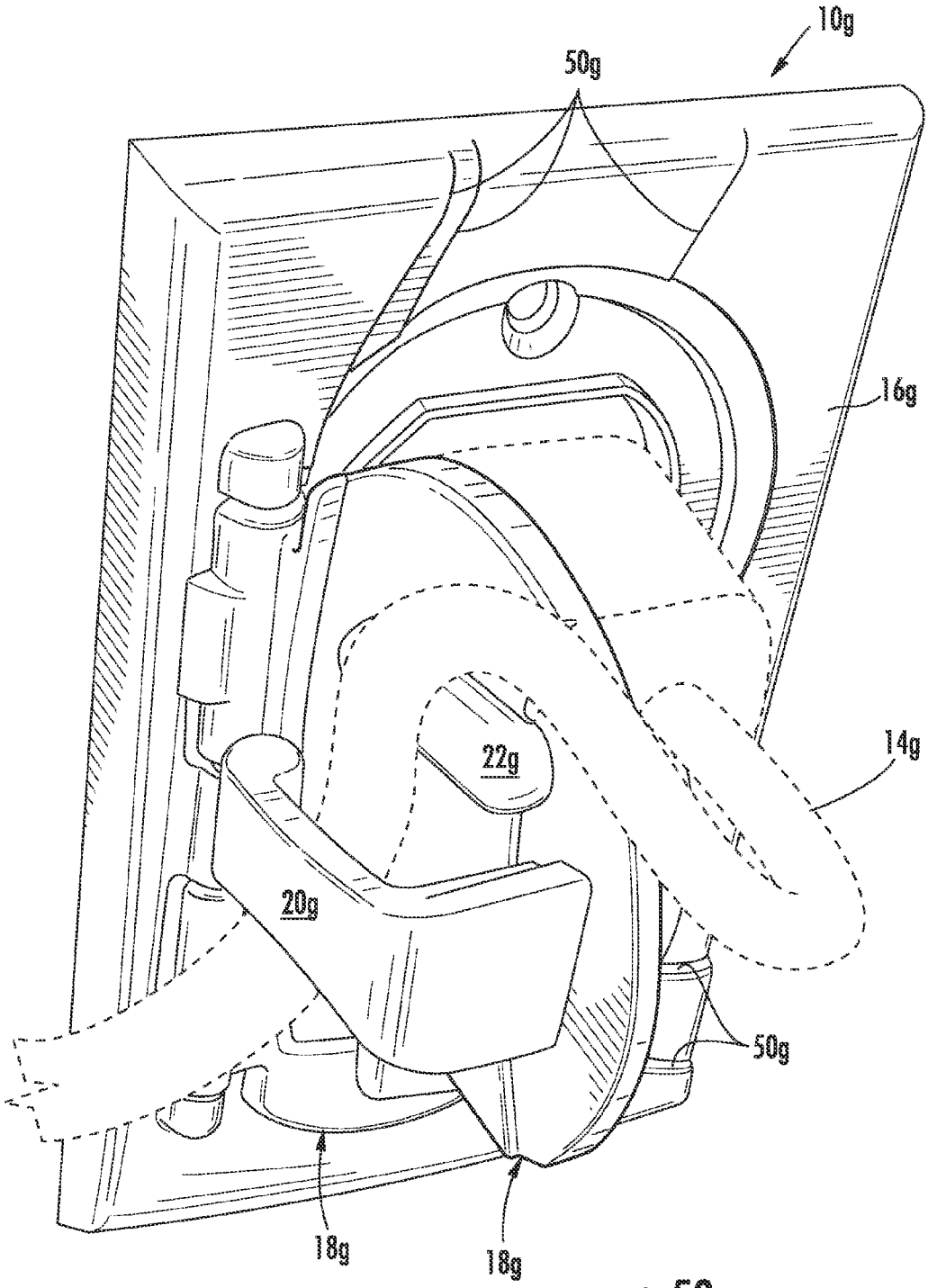
FIG. 59 is a perspective view of the outlet cover of FIG. 52, showing the outlet cover in use with a standard electrical outlet and securing a power cord from being inadvertently electrically disconnected from the outlet.
Figure 60:
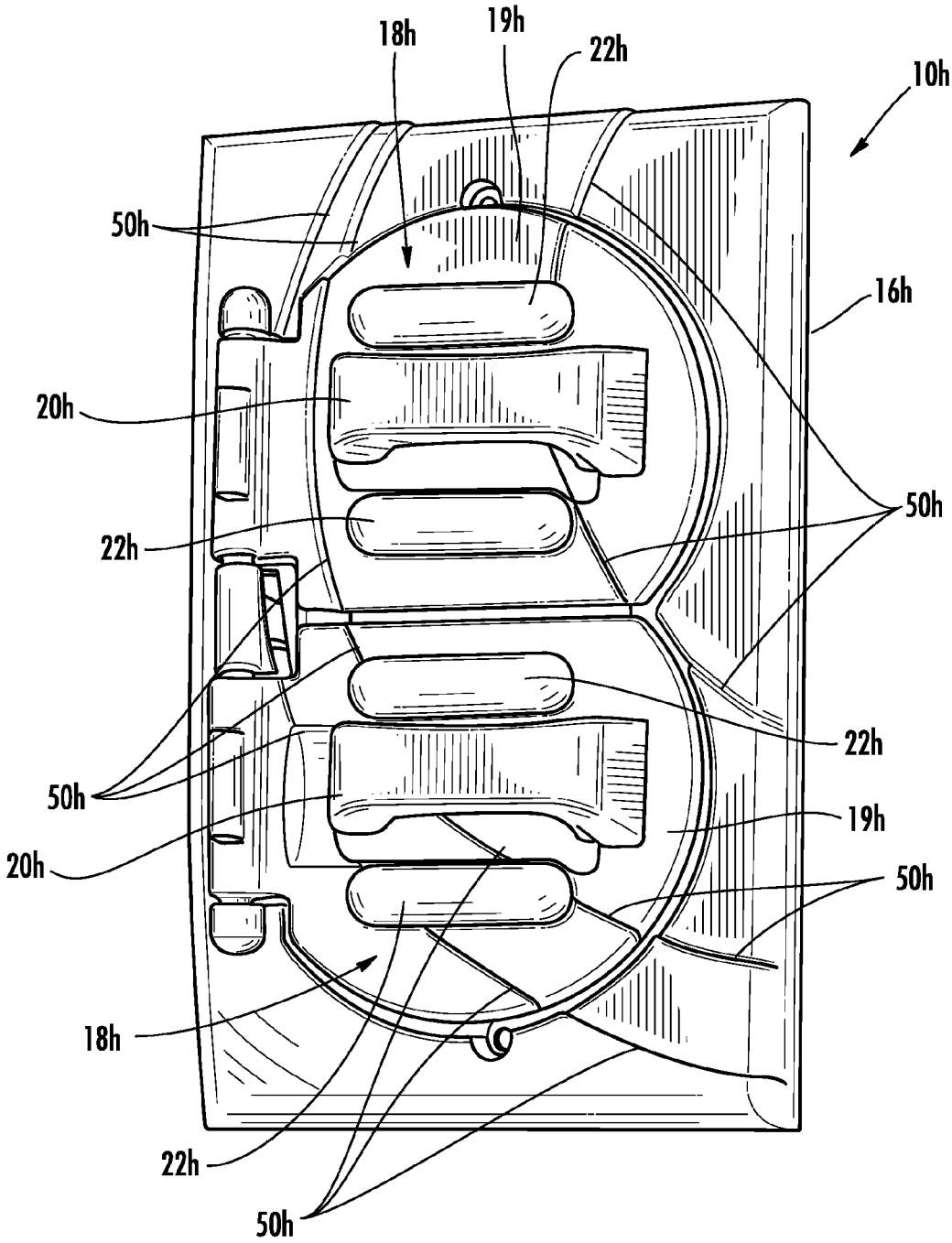
FIG. 60 is a perspective view of another power cord securing outlet cover that is functionally similar and having designer features that are similar to the embodiment illustrated by FIGS. 52-58, but being suitable for application with a GFI electrical outlet.
Figure 61:
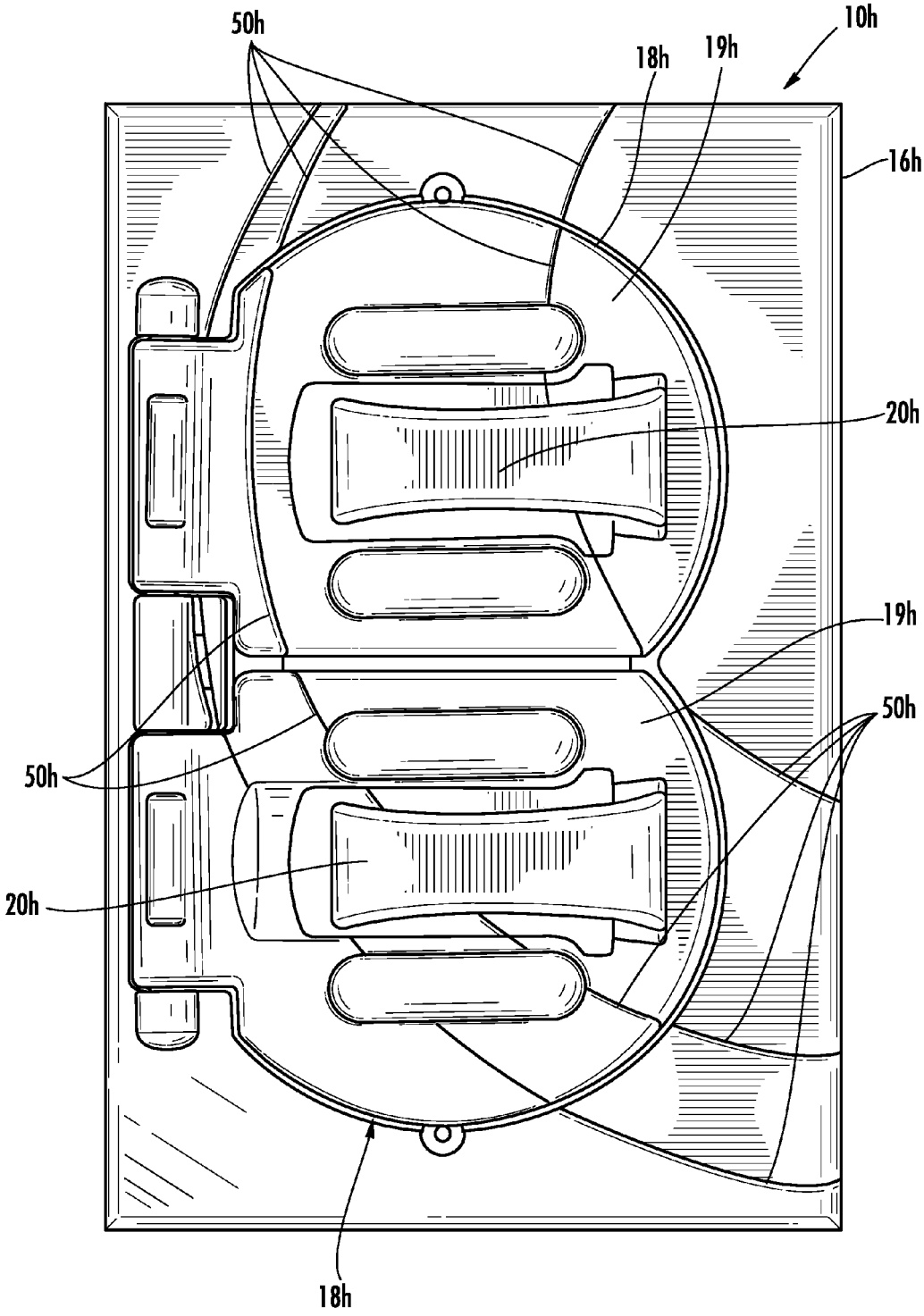
FIG. 61 is a front elevational view of the outlet cover of FIG. 60.
Figure 62:
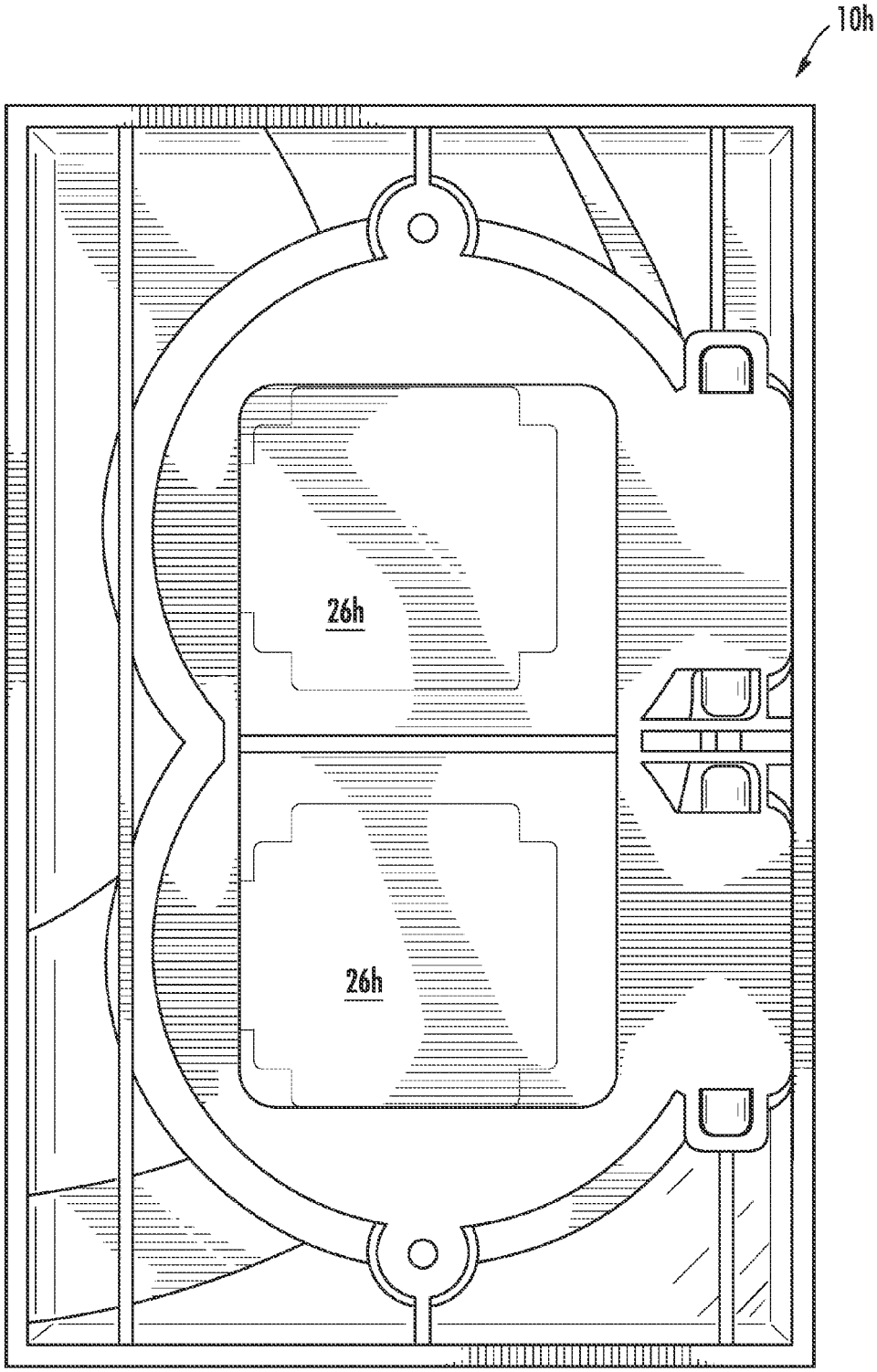
FIG. 62 is a rear elevational view of the outlet cover of FIG. 60.
Figure 63:
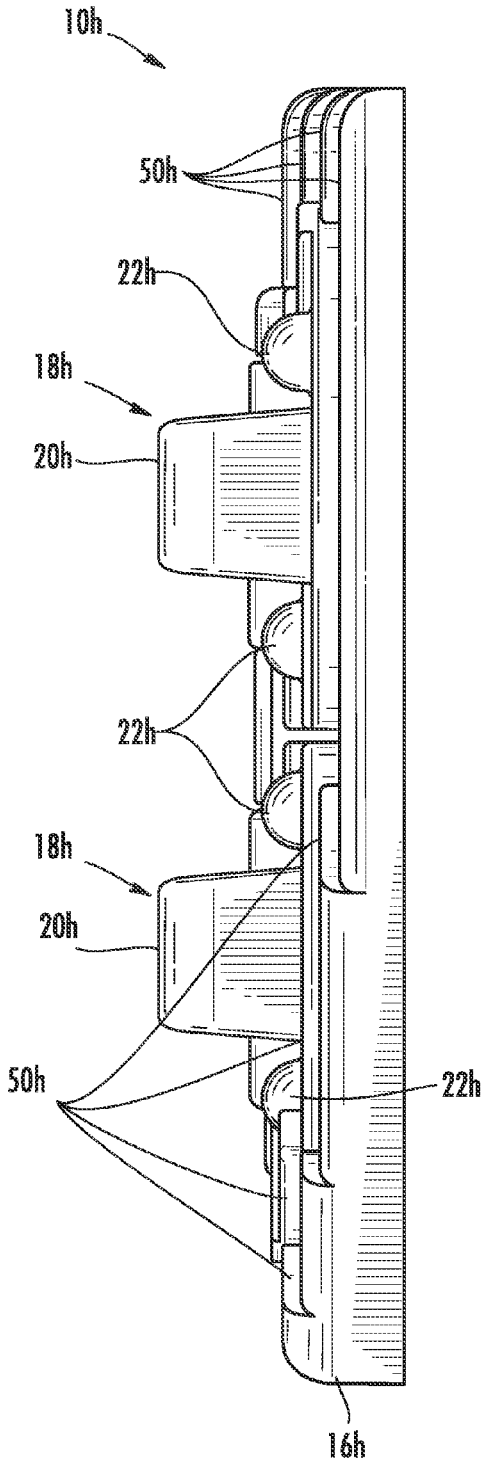
FIG. 63 is a right side elevational view of the outlet cover of FIG. 60.
Figure 64:
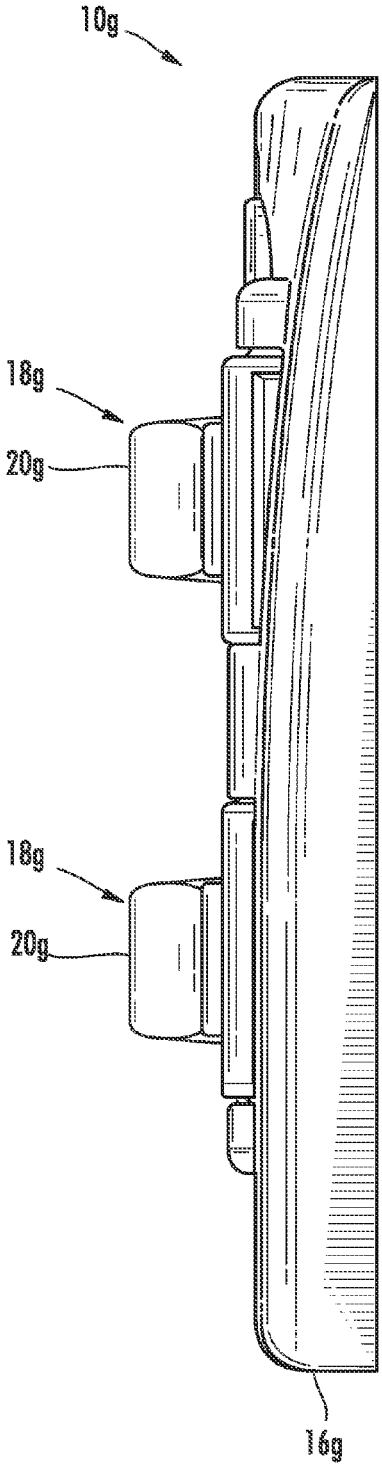
FIG. 64 is a left side elevational view of the outlet cover of FIG. 60.
Figure 65:
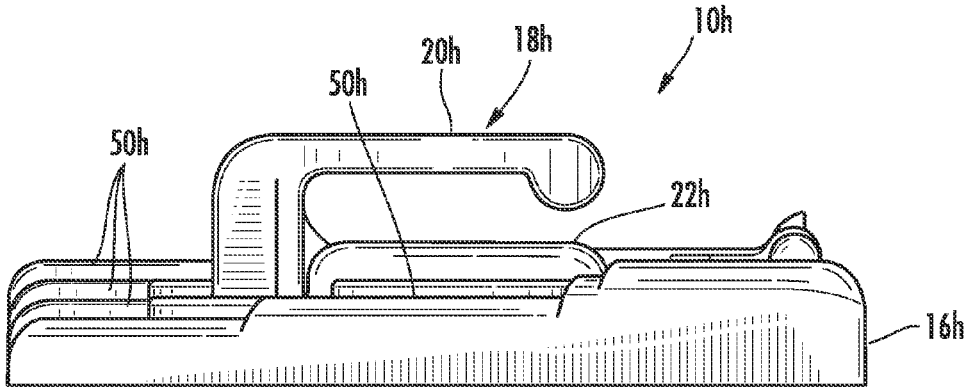
FIG. 65 is a top plan view of the outlet cover of FIG. 60.
Figure 66:
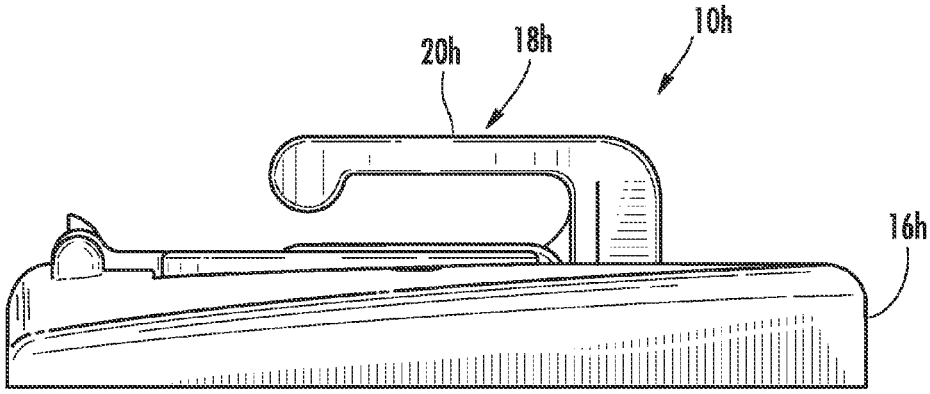
FIG. 66 is a bottom plan view of the outlet cover of FIG. 60.
Figure 67:
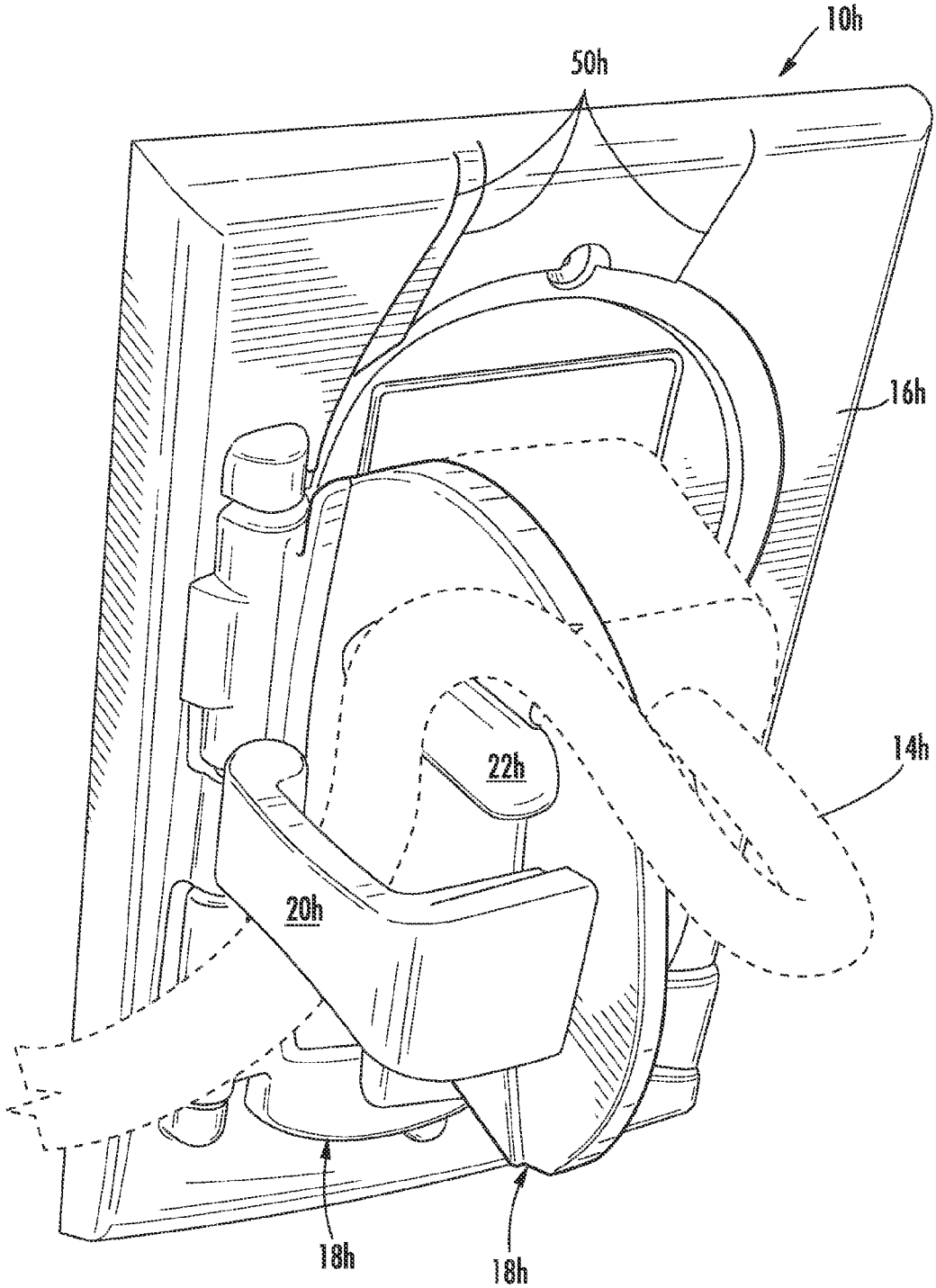
FIG. 67 is a perspective view of the outlet cover of FIG. 44, showing the outlet cover in use with a GFI electrical outlet and securing a power cord from being inadvertently electrically disconnected from the outlet.

Referring to FIG. 8, a less preferred embodiment of an outlet cover 10*a* is illustrated. The outlet cover 10*a* is the same in function and configuration as the embodiment described herein in reference to FIGS. 1-7A and, as such, all of the prior description is incorporated into the instant embodiment with following differences. The outlet cover 10*a* includes only one bump 22*a*. Thus, the cord 14 will still travel a non-linear path, but it may not be in a U-shape nor secured as tightly.

Referring to FIGS. 9-15A, an alternative embodiment of an outlet cover 10*b* is illustrated. The outlet cover 10*b* is the same in function and configuration as the embodiment described herein in reference to FIGS. 1-7A and, as such, all of the prior description is incorporated into the instant embodiment with following differences. The outlet cover 10*b* includes a prong 20*b* and bumps 22*b* having horizontal longitudinal axes (LP, LB) when the cover 10*a* is attached to an electrical outlet 12. And, the prong 20*b* is directed leftwardly, which may be preferred by some adults.

Referring to FIGS. 16-25, another alternative embodiment of an outlet cover 10*c* is illustrated. The outlet cover 10*c* is the same in function and configuration as the embodiment described herein in reference to FIGS. 1-7A and, as such, all of the prior description is incorporated into the instant embodiment with following differences. The outlet cover 10*c* includes a prong 20*c* and bumps 22*c* having horizontal longitudinal axes (LP, LB) when the cover 10*c* is attached to an electrical outlet 12, wherein the prong 20*c* is directed rightwardly.

Referring to FIGS. 26-35, another alternative embodiment of an outlet cover 10*d* is illustrated. The outlet cover 10*d* is the same in function and configuration as the embodiment described herein in reference to FIGS. 1-7A and, as such, all of the prior description is incorporated into the instant embodiment with following differences. The outlet cover 10*d* includes a prong 20*d* and bumps 22*d* having vertical longitudinal axes (LP, LB) when the cover 10*d* is attached to an electrical outlet 12, wherein the prong 20*d* is directed downwards.

Referring to FIGS. 36-67, other alternative embodiments of outlet covers 10*e*-10*h* are illustrated. The outlet covers 10*e*-10*h* have the same function and same basic configuration as the embodiment described herein in reference to FIGS. 1-7A and, as such, all of the prior description is incorporated into the instant embodiment, except the outlet covers 10*e*-10*h* have a designer appearance, prong 20*g*, 20*h* and bumps 22*g*, 22*h* for outlet covers 10*g*, 10*h* are oriented horizontally, and outlet covers 10*f*, 10*h* are configured for use with GFI outlets. To achieve a designer appearance, the outlet covers 10*e*-10*h* are provided with a plurality of arcing stepped features 50*e*-50*h* in the base plate 16 and base 19 of the hinged lids 18. The arcing features 50*e*-50*h* have the appearance of continuous arcs carried through the base plate 16 and base 19. The arcing features 50*e*-50*h* are stepped such that subsequent arcing feature 50*e*-50*h* are positioned higher than previous features 50*e*-50*h*. Also, the base 19*e*-19*h* of the lids 18*e*-18*h* are more rounded that that illustrated in the embodiment of FIGS. 1-7A, which contributes to the designer look.

In the various embodiments, it is shown that the prong 20 may be directed in various direction such as, for example, upwards, downwards, leftwards and rightwards. Although different orientation may be used, some adults may find it easier to secure the cord 14 when the prong 20 is directed upwards. Notwithstanding, the leftward directed prong 20 (towards the hinge) may offer greater securement of the cord 14 than other prong orientations. It is also contemplated that the rightward directed prong 20 (away from the hinge) may offer the least resistance to tension forces in that sufficient tension forces may cause the cord 14 to be pulled out from the outlet cover 10.

It is to be understood that the teachings of the present invention are not limited to being useful with only two socket or standard electrical outlets. It is within the scope of the present invention to adapt the outlet cover for use with electrical outlets having any number of outlets. Additionally, the invented outlet cover has utility with different types of electrical outlets beyond just a standard outlet. For example, the outlet cover can be configured for use with GFI outlets as illustrated in FIGS. 45-51 and 60-67.

The foregoing provides a detailed description of exemplary embodiments of the present invention. Although specific embodiments of an outlet cover for electrical outlets which prevents unintentional disconnection of an electrical plug from an electrical outlet have been described with reference to preferred embodiments and examples thereof, other embodiments and examples may perform similar functions and/or achieve similar results. All such equivalent embodiments and examples are within the spirit and scope of the present invention and are intended to be covered by the following claims That which is claimed is:

1. An outlet cover for an electrical outlet which prevents unintentional disconnection of an electrical cord from the electrical outlet, comprising:

a plate having at least one opening sized and positioned to receive an electrical plug;

a lid hingedly attached to the plate so that the lid can be moved between an open position that allows access to the electrical outlet and a closed position wherein the electrical outlet is covered by the lid;

wherein the lid includes a base, a prong having a proximal portion connected to, and extending outwardly from, the base, and a distal portion that is spaced from the base by the proximal portion, and at least one bump extending outwardly from the base; and wherein the electrical cord is capable of being positioned between the prong and the base, and between the prong and the at least one bump, whereby the electrical cord engages the prong and the at least one bump, and the prong and the at least one bump cooperate together to secure the electrical cord such that the electrical plug is not unintentionally disconnected from an electrical outlet when a tension force is applied to the electrical cord.

2. The outlet cover in accordance with claim 1, wherein the at least one bump includes a first bump and a second bump, wherein said first and second bumps are on opposed side of the prong.

3. The outlet cover in accordance with claim 2, wherein the distal portion has a longitudinal axis and a length along its longitudinal axis of at least ⅓ inch, the first bump has a longitudinal axis and a length along its longitudinal axis of at least ⅓ inch, and the second bump has a longitudinal axis and a length along its longitudinal axis of at least ⅓ inch, wherein the longitudinal axes are generally parallel with each other.

4. The outlet cover in accordance with claim 3, wherein the first and second bumps have a length that is about or greater than the distal portion of the prong.

5. The outlet cover in accordance with claim 2, wherein the distal portion has a length, a distal end, and a center point the length, wherein the distal end is closer in proximity to the base than the center point is from the base.

6. The outlet cover in accordance with claim 2, wherein said first and second bumps extend outwardly from the base by at least ⅛ inch.

7. The outlet cover in accordance with claim 6, wherein the distal portion of the prong has a center point, wherein the shortest distance between the center point and the base is greater than the height difference of the center point compared to the first bump or second bump.

8. The outlet cover in accordance with claim 2, wherein a tension force applied to the electrical cord is resisted by the prong and the first and second bumps such that the tension force is not transmitted to the electrical plug.

9. The outlet cover in accordance with claim 2, wherein less than 0.5 N of tension force is transmitted to the electrical plug when 10 N of tension force is applied to the electrical cord.

10. The outlet cover in accordance with claim 2, wherein less than 0.5 N of tension force is transmitted to the electrical plug when 20 N of tension force is applied to the electrical cord.

11. The outlet cover in accordance with claim 2, wherein the outlet cover has a plurality of arcing stepped features that are provided through the plate and the base.

12. A method of securing an electrical cord to prevent unintentional disconnection the electrical cord from an electrical outlet, including the steps of:

providing an outlet cover comprising a plate having at least one opening sized and positioned to receive the electrical plug, a lid hingedly attached to the plate, wherein the lid includes a base having an outward facing surface, a base, a prong having a proximal portion connected to, and extending outwardly from, the base, and a distal portion that is spaced from the base by the proximal portion, and at least one bump extending outwardly from the base;

moving the lid to an open position that allow for access to the electrical outlet;

inserting the electrical cord through the at least one opening;

plugging the electrical cord to the electrical outlet;

positioning the electrical cord between the prong and the base;

positioning the electrical cord between the prong and the at least one bump whereby the electrical cord is engaged against the prong and the at least one bump;

applying a tension force to the electrical cord;

restricting movement of the electrical cord by engaging the electrical cord against the prong and at least one bump such that the electrical cord does not become disengaged from the electrical outlet.

13. The method in accordance with claim 12, wherein the at least one bump includes a first bump and a second bump, wherein said first and second bumps are on opposed side of the prong.

14. The method in accordance with claim 13, wherein the distal portion has a length along its longitudinal axis of at least ⅓ inch, the first bump has a length along its longitudinal axis of at least ⅓ inch, and the second bump has a length along long its longitudinal axis of at least ⅓ inch, wherein the longitudinal axes are generally parallel with each other.

15. The method in accordance with claim 14, wherein the first and second bumps and distal portion of the prong have about the same length.

16. The method in accordance with claim 13, wherein the distal portion has a distal end and a center along its length, wherein the distal portion is closer in proximity to the outward facing surface of the base than the center is from the outward facing surface.

17. The method in accordance with claim 13, wherein said first and second bumps extend outwardly at least ⅛ inch from the outward facing surface of said base.

18. The method in accordance with claim 17, wherein the proximal portion of the prong has a center, wherein the shortest distance between the center and the outward facing surface is greater than the height difference of the center compared to the bump.

19. The method in accordance with claim 13, further including the step of restricting tension forces applied to the electrical cord from being transmitted to the electrical plug.

20. The method in accordance with claim 13, further including the step of positioning the electrical cord over the first and second bumps and under the distal end of the prong.

* * * * *